US011692337B2

(12) United States Patent
Gupta et al.

(10) Patent No.: US 11,692,337 B2
(45) Date of Patent: Jul. 4, 2023

(54) BIDET WASHING APPARATUS WITH DISINFECTANT WASH FEATURE

(71) Applicant: 2Go Products, LLC, San Diego, CA (US)

(72) Inventors: Anjum Gupta, San Diego, CA (US); Bowen Zhang, San Diego, CA (US)

(73) Assignee: 2Go Products, LLC, San Diego, CA (US)

( * ) Notice: Subject to any disclaimer, the term of this patent is extended or adjusted under 35 U.S.C. 154(b) by 0 days.

(21) Appl. No.: 17/555,879

(22) Filed: Dec. 20, 2021

(65) Prior Publication Data

US 2022/0162843 A1 May 26, 2022

Related U.S. Application Data

(63) Continuation-in-part of application No. 17/473,211, filed on Sep. 13, 2021, now abandoned, which is a continuation of application No. 16/567,107, filed on Sep. 11, 2019, now Pat. No. 11,155,987, which is a continuation-in-part of application No. 16/374,970, filed on Apr. 4, 2019, now Pat. No. 10,844,586.

(51) Int. Cl.

| | |
|---|---|
| ***E03D 9/08*** | (2006.01) |
| ***E03D 9/00*** | (2006.01) |
| ***B05B 15/55*** | (2018.01) |
| ***B05B 9/03*** | (2006.01) |

(52) U.S. Cl.

CPC ..... *E03D 9/08* (2013.01); *B05B 9/03* (2013.01); *B05B 15/55* (2018.02); *E03D 9/005* (2013.01)

(58) Field of Classification Search

CPC ..... E03D 11/02
USPC ..... 4/448, 443, 420.4, 447
See application file for complete search history.

(56) References Cited

U.S. PATENT DOCUMENTS

| | | | | |
|---|---|---|---|---|
| 6,973,679 | B1 * | 12/2005 | Schad | E03D 9/085 4/443 |
| 10,844,586 | B2 * | 11/2020 | Gupta | E03C 1/12 |
| 11,155,987 | B2 * | 10/2021 | Gupta | E03C 1/12 |
| 2008/0301866 | A1 | 12/2008 | Allard | |
| 2010/0037381 | A1 * | 2/2010 | Bowen | E03D 9/085 4/444 |
| 2022/0274771 | A1 * | 9/2022 | Sylvia | B05B 15/70 |

(Continued)

FOREIGN PATENT DOCUMENTS

| | | | |
|---|---|---|---|
| CN | 105971083 | A | 9/2016 |
| GB | 21166 | A | 7/1913 |
| KR | 2010 0027550 | A | 3/2010 |

(Continued)

*Primary Examiner* — Lori L Baker
(74) *Attorney, Agent, or Firm* — Edward D. Robinson

(57) ABSTRACT

A reservoir dispenser for a bidet apparatus includes a housing unit having a first chamber and a second chamber, wherein the first chamber can hold liquid wash solution separate from the second chamber. The first chamber can include a lid with an opening therein; an activator located within the opening of the lids; and a stem and end piece located within the first chamber. The second chamber can include a water inlet and a water outlet for flow of water through the apparatus. Located between the first and second chamber is a check valve, which allows for the controlled transfer of liquid wash solution from the first chamber to the second chamber.

28 Claims, 39 Drawing Sheets

(56) References Cited

U.S. PATENT DOCUMENTS

| | | | | |
|---|---|---|---|---|
| 2022/0298771 | A1* | 9/2022 | Gupta | B05B 7/2464 |
| 2022/0341146 | A1* | 10/2022 | Gupta | B05B 9/03 |

FOREIGN PATENT DOCUMENTS

| | | | |
|---|---|---|---|
| WO | WO 2013/147408 | A1 | 10/2013 |
| WO | WO 2020/0161681 | A1 | 4/2020 |

* cited by examiner

BIDET WASHING APPARATUS WITH DISINFECTANT WASH FEATURE

CROSS-REFERENCE TO RELATED APPLICATIONS

This application is a continuation-in-part of and claims the benefit of priority under 37 USC § 120 to U.S. patent application Ser. No. 17/473,211, titled: BIDET WASHING APPARATUS WITH DISINFECTANT WASH FEATURE." filed on Sep. 13, 2021, which is a continuation of and claims the benefit of priority to U.S. patent application Ser. No. 16/567,107, titled: BIDET WASHING APPARATUS WITH DISINFECTANT WASH FEATURE," filed on Sep. 11, 2019, now U.S. patent Ser. No. 11/155,987, which is a continuation-in-part of and claims the benefit of priority to U.S. patent application Ser. No. 16/374,970, titled: "BIDET WASHING APPARATUS WITH DISINFECTANT WASH FEATURE." filed on Apr. 4, 2019, now U.S. Pat. No. 10,844,586, the disclosure of each of which is hereby incorporated by reference in their entireties for all purposes.

FIELD OF THE INVENTION

The disclosure generally relates to a bidet washing apparatus, and more particularly to a bidet washing apparatus having a disinfectant wash feature that can store and dispense a cleaning disinfectant with a bidet washing stream.

BACKGROUND OF THE INVENTION

A bidet apparatus for washing and cleaning body parts was initially developed in the form of a bidet that provided a single spray of water and was permanently built into the toilet bowl. However, such bidets were expensive, and a new generation of bidets was developed that were attachable to the toilet and included a plurality of nozzles for multiple water sprays. Such bidets can be attached to the seat of an existing toilet bowl for washing the private parts of a person.

Various bidet designs have addressed some of the desired effects, such as washing, washing with temperature-regulated water, and drying. However, existing bidets tail to address all concerns related to the designs and functions in the general field of bidets. For example, pollution of the outer surface of the nozzles, the bidet and toilet during utilization is a common problem and causes aesthetic and hygienic issues. This is particularly important in bidets used, for example, by infirm or sick people who have to be especially cautious about maintaining hygiene and preventing infections.

Currently there aren't any bidets that include a disinfectant wash feature. Many bidets have a feature to clean the nozzle of the bidet, however, cleaning the nozzle with water causes problems as it could leave behind hard water deposits and not provide adequate cleaning. Hard water deposits on the nozzle could affect the flow of the bidet as it blocks the nozzle holes and not adequately cleaning the bidet raises sanitary concerns. Consumers may also feel that normal water may not provide adequate washing of their body parts. Therefore, there remains a need to provide bidets with a disinfectant wash feature.

SUMMARY OF THE INVENTION

The disclosed embodiments are directed to solving one or more of the problems presented in the prior art, described above, as well as providing additional features that will become readily apparent by reference to the following detailed description when taken in conjunction with the accompanying drawings.

In an embodiment, the disclosure provides a reservoir dispenser for a bidet washing apparatus including a housing unit having a first chamber and a second chamber, wherein the first chamber is capable of holding liquid wash solution separate from the second chamber, a water inlet and a water outlet on the second chamber; a lid having an opening therein, wherein the lid is attached to the first chamber; an activator having a stem and an endpiece, wherein the activator is within the opening of the lid, and the stem and endpiece are in the first chamber, and a check valve between the first chamber and the second chamber, wherein engaging the activator allows for transfer of the liquid wash solution from the first chamber, through the check valve and into the second chamber.

In one aspect, the disclosure provides a reservoir dispenser for a bidet washing apparatus which also includes a spring surrounding the stem; a barrel surrounding the spring and the stem, wherein the barrel includes a top region, middle region, and lower region, wherein the top region is in the first chamber, the middle region is between the first chamber and the second chamber, and the lower region is in the second chamber.

In another aspect, the disclosure provides a reservoir dispenser for a bidet washing apparatus wherein the check valve includes a check valve body including sidewalls of the middle region and/or lower region of the barrel; a check valve disc; a check valve spring; and a check valve guide having one or more openings there through.

In another aspect, the disclosure provides a reservoir dispenser for a bidet washing apparatus wherein the middle region of the barrel includes one or more openings to allow the liquid wash solution present in the first chamber to pass through to the check valve disc.

In another aspect, the disclosure provides a reservoir dispenser for a bidet washing apparatus wherein engaging the activator allows the end piece to press against the liquid wash solution that passed through to the check valve disc and against the check valve body, thereby forcing the check valve disc downwards and compressing the check valve spring, allowing the liquid wash solution to pass through the one or more openings in the check valve guide and into the second chamber.

In another aspect, the disclosure provides a reservoir dispenser for a bidet washing apparatus wherein disengaging the activator elongates the check valve spring and forces the check valve disc upwards, which separates the first chamber from the second chamber.

In another embodiment, the disclosure provides a reservoir dispenser for a bidet washing apparatus including a housing unit having a first chamber and a second chamber, wherein the first chamber is capable of holding liquid wash solution separate from the second chamber; a water inlet and a water outlet on the second chamber; a lid having an opening therein, wherein the lid is attached to the first chamber; an annular ring between the first chamber and the second chamber; an activator having a stem with a top ring, a medial ring, and a distal ring, wherein the top ring and medial ring are in the first chamber and the distal ring is in the second chamber, wherein engaging the activator allows for transfer of the liquid wash solution from the first chamber, through the annular ring and into the second chamber.

In one aspect, the disclosure provides a reservoir dispenser for a bidet washing apparatus wherein the annular ring includes an internal lip, wherein the internal lip is between the first chamber and the second chamber.

In another aspect, the disclosure provides a reservoir dispenser for a bidet washing apparatus, further including a post and one or more springs surrounding the post on a floor of the second chamber, wherein the stem includes an inlet for accepting the post.

In another aspect, the disclosure provides a reservoir dispenser for a bidet washing apparatus wherein the liquid wash solution present in the first chamber fills an area between the medial ring and the distal ring of the activator.

In another aspect, the disclosure provides a reservoir dispenser for a bidet washing apparatus wherein engaging the activator allows the medial ring of the stem to press against the liquid wash solution, thereby forcing the distal ring of the stem downwards and compressing the one or more springs on the floor of the second chamber, allowing the liquid wash solution to pass the internal lip of the annular ring and into the second chamber.

In another aspect, the disclosure provides a reservoir dispenser for a bidet washing apparatus wherein disengaging the activator elongates the one or more springs on the floor of the second chamber and forces the stem upwards, which separates the first chamber from the second chamber.

In another embodiment, the disclosure provides a reservoir dispenser for a bidet washing apparatus including a housing unit having a first chamber and a second chamber, wherein the first chamber is capable of holding liquid wash solution separate from the second chamber; a water inlet and a water outlet on the second chamber; a lid having an opening therein, wherein the lid is attached to the first chamber; an activator having a stem with one or more grooved openings in a distal region of the stem, wherein the activator is within the opening of the lid and the stem and the one or more grooved openings are in the first chamber, wherein engaging the activator allows for transfer of the liquid wash solution from the first chamber into the second chamber.

In one aspect, the disclosure provides a reservoir dispenser for a bidet washing apparatus, further including a spring surrounding the stem; a barrel surrounding the spring and the stem in the first chamber, wherein the barrel includes a top region and a bottom region.

In another aspect, the disclosure provides a reservoir dispenser for a bidet washing apparatus wherein the stem includes an O-ring encircling an area of the stem between the one or more grooved openings and a terminal end of the stem.

In another aspect, the disclosure provides a reservoir dispenser for a bidet washing apparatus wherein the bottom region of the barrel includes one or more openings to allow the liquid wash solution present in the first chamber to pass through to fill the one or more grooved openings in the distal region of the stem.

In another aspect, the disclosure provides a reservoir dispenser for a bidet washing apparatus wherein engaging the activator allows the stem and liquid wash solution present in the one or more grooved openings in the distal region of the stem downwards and compressing the spring surrounding the stem, allowing the liquid wash solution present in the one or more grooved openings to pass through the first chamber and into the second chamber.

In another aspect, the disclosure provides a reservoir dispenser for a bidet washing apparatus wherein disengaging the activator elongates the spring surrounding the stem and forces the stem upwards, which separates the first chamber from the second chamber.

In another embodiment, the disclosure provides a reservoir dispenser for a bidet washing apparatus including a housing unit having a first chamber and a second chamber, wherein the first chamber is capable of holding liquid wash solution separate from the second chamber; a water inlet and a water outlet on the second chamber; a lid having an opening therein, wherein the lid is attached to the first chamber; an activator having a stem with a narrowed band in a distal region, wherein the activator is within the opening of the lid and the stem and the narrowed band are in the first chamber, wherein engaging the activator allows for transfer of the liquid wash solution from the first chamber into the second chamber.

In one aspect, the disclosure provides a reservoir dispenser for a bidet washing apparatus, further including a spring surrounding the stem.

In another aspect, the disclosure provides a reservoir dispenser for a bidet washing apparatus wherein the stem includes an upper O-ring encircling an area of the stem above the narrowed band; and a lower O-ring encircling an area of the stem below the narrowed band and a terminal end of the stem.

In another aspect, the disclosure provides a reservoir dispenser for a bidet washing apparatus wherein engaging the activator allows the stem and liquid wash solution present in the narrowed band in the distal region of the stem downwards and compressing the spring surrounding the stem, allowing the liquid wash solution present in the narrowed band of the stem to pass through the first chamber and into the second chamber.

In another aspect, the disclosure provides a reservoir dispenser for a bidet washing apparatus wherein disengaging the activator elongates the spring surrounding the stem and forces the stem upwards, which separates the first chamber from the second chamber.

In another embodiment, the disclosure provides a method for delivering liquid wash solution from a reservoir dispenser for a bidet apparatus, including engaging an activator to allow transfer of the liquid wash solution from the first chamber to the second chamber; and disengaging the activator to stop the transfer of the liquid wash solution.

Further features and advantages of the disclosure, as well as the structure and operation of various embodiments of the disclosure, are described in detail below with reference to the accompanying drawings.

BRIEF DESCRIPTION OF THE DRAWINGS

The disclosure, in accordance with one or more various embodiments, is described in detail with reference to the following figures, The drawings are provided for purposes of illustration only and merely depict exemplary embodiments of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

DETAILED DESCRIPTION OF EXEMPLARY EMBODIMENTS

Figure 1:
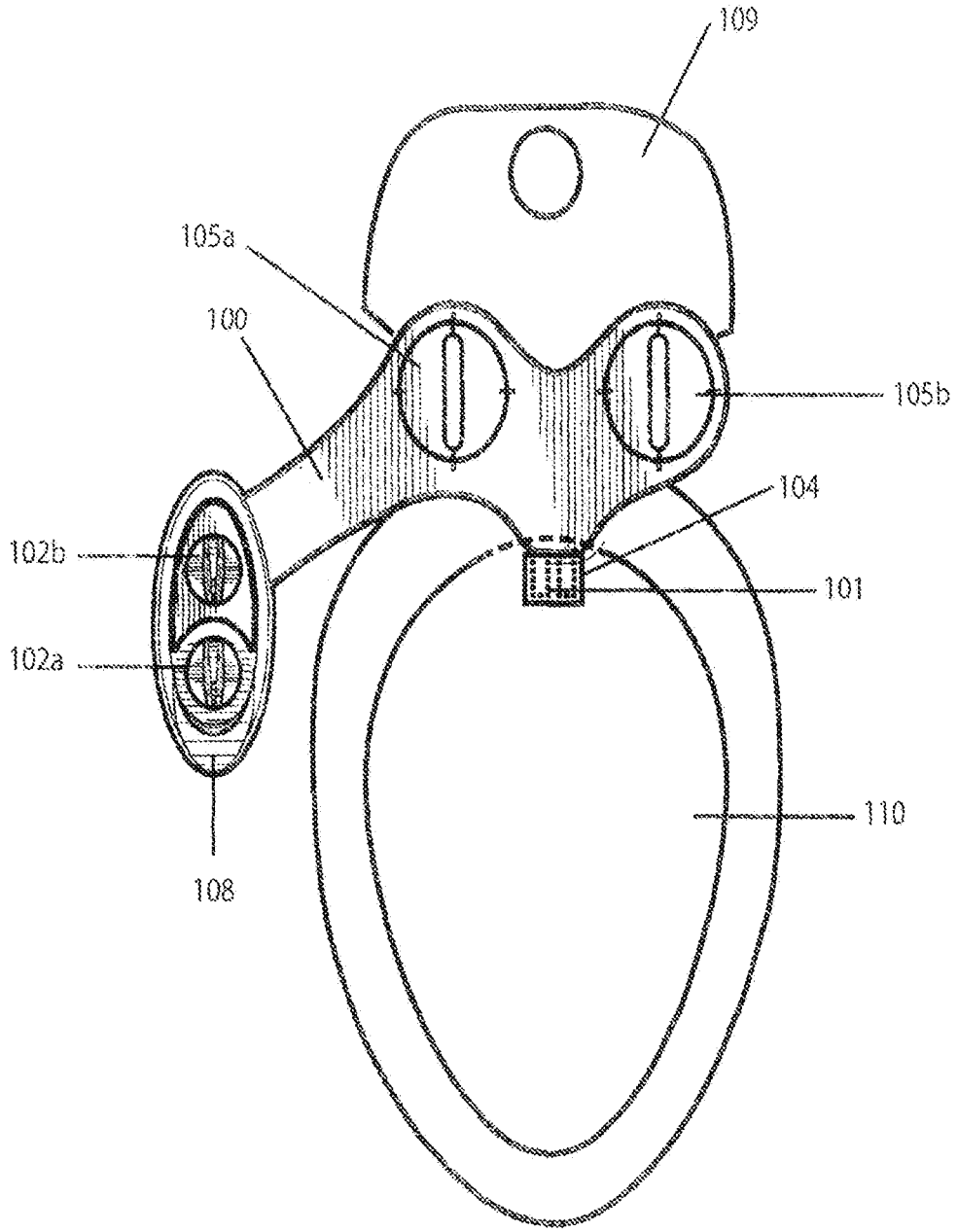
FIG. 1 illustrates an embodiment of a perspective view of an exemplary bidet washing apparatus installed on an existing toilet seat, with the seat cover up.

The following description is presented to enable a person of ordinary skill in the art to make and use embodiments described herein. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the disclosure. Thus, the disclosure is not intended to be limited to the examples described herein and shown but is to be accorded the scope consistent with the claims.

The word "exemplary" is used herein to mean "serving as an example illustration," Any aspect or design described herein as "exemplary" is not necessarily to be construed as preferred or advantageous over other aspects or designs.

Reference will now be made in detail to aspects of the subject technology, examples of which are illustrated in the accompanying drawings, wherein like reference numerals refer to like elements throughout.

It should be understood that the specific order or hierarchy of steps in the process disclosed herein is an example of exemplary approaches. Based upon design preferences, it is understood that the specific order or hierarchy of steps in the processes can be rearranged while remaining within the scope of the disclosure. Any accompanying method claims present elements of the various steps in, a sample order, and are not meant to be limited to the specific order or hierarchy presented.

The embodiments disclosed herein describe a new, clean and hygienic washing bidet. The various embodiments include one or a plurality of water inlets, a control means housing one or a plurality of control valves to control the flow of water from the water inlets to one or a plurality of water tubes, one or a plurality of washing nozzles, a protective shield gate, and securing unit configured to securing the sanitary washing device to the toilet seat.

The disclosed embodiments directed to clean and hygienic bidet washing apparatus 100 attachable to an existing toilet, for cleaning the body parts of the user sitting on or near the toilet.

As described herein, a "bidet" is a toilet attachment for cleaning the body parts of the user.

As described herein, the term "water inlet" means any structure that may provide water to the bidet washing apparatus.

As described herein, a "control unit" (aka "control panel") is the housing which has "control switche(s)" thereon controlling the various functionalities of the bidet, including but, not limited to, flow of water, adjusting the angle of the nozzles, and opening and closing the protective shield gate.

As described herein, "control valves" are, controller parts located inside the control panel housing which control the flow of water or other fluids from the water inlet(s) to one or more "water tubes" by opening, closing or partially obstructing various passageways.

As described herein, "water tubes" are channels that connect the control valves to a "nozzle assembly," wherein, the "nozzle assembly" includes a single nozzle or a collection of nozzles including at least one "washing nozzle."

As described herein, a "nozzle" is a device designed to eject water or other fluids into the surrounding medium as a coherent controlled spray.

As described herein, the "washing nozzle" is the nozzle that can be used to wash the body parts of a user.

As described herein, the "nozzle assembly" may also have other types of nozzles such as a "self-cleaning nozzle," which is used to clean the nozzle assembly itself, a "toilet cleaning nozzle," which is used to clean the bidet and/or the toilet, and a "shield cleaning nozzle," which is used for cleaning the "protective shield gate."

As described herein, the "protective shield gate" is a structure placed at least partially in front of the nozzle assembly (e.g., between the user and the nozzle assembly) to protect the nozzle assembly from pollutants.

As described herein, the "protective shield gate" ran have a "hinged" edge. The term "hinged" here means a joint that allows the turning or pivoting of the gate, by any conventional turning or pivoting mechanism.

As described herein, the term "fluidically coupled" means a connection or a passageway which allows fluid to flow therethrough.

As described herein, the term "reservoir" means a fluid holding tank.

Accordingly, in one embodiment the disclosure provides a bidet washing apparatus attachable to a toilet bowl for cleaning one or more body parts of a user. The apparatus can include one or more water inlets configured to supply water, and a control unit, housing one or more valves fluidically connected to the one or more water inlets, including one or more control switches configured to operate the one or more valves. As such, the one or more valves can control water flow from the one or more water inlets. The apparatus can further include a nozzle assembly including at least one washing nozzle, fluidically connected to at least one of the one or more valves with one or more water tubes. The at least one washing nozzle can be positioned for directing water to the one or more body parts of the user. The apparatus can also include a protective shield gate covering at least a portion of the at least one washing nozzle, where the protective shield gate is rotatably coupled to the bidet washing apparatus.

According to various embodiments, the protective shield gate can be rotatably coupled to the apparatus along a side or top edge via a hinge, for example, in order to allow for the manual or electrical opening and closing of the protective shield gate. In this matter, the nozzle(s) are easily accessible for cleaning, removal, replacement or other adjustment while the protective shield gate is open. In an alternative embodiment, the protective shield gate can be completely removed to similarly provide access to the nozzle(s).

According to another embodiment, the water inlet(s) can be fluidically connected to one or more valves via a single-body connector without any intervening parts or joints, which results in a more robust, long-lasting, bidet washing apparatus, since leaks or other damage to the fluidic couplings are less likely to occur.

Figure 2:
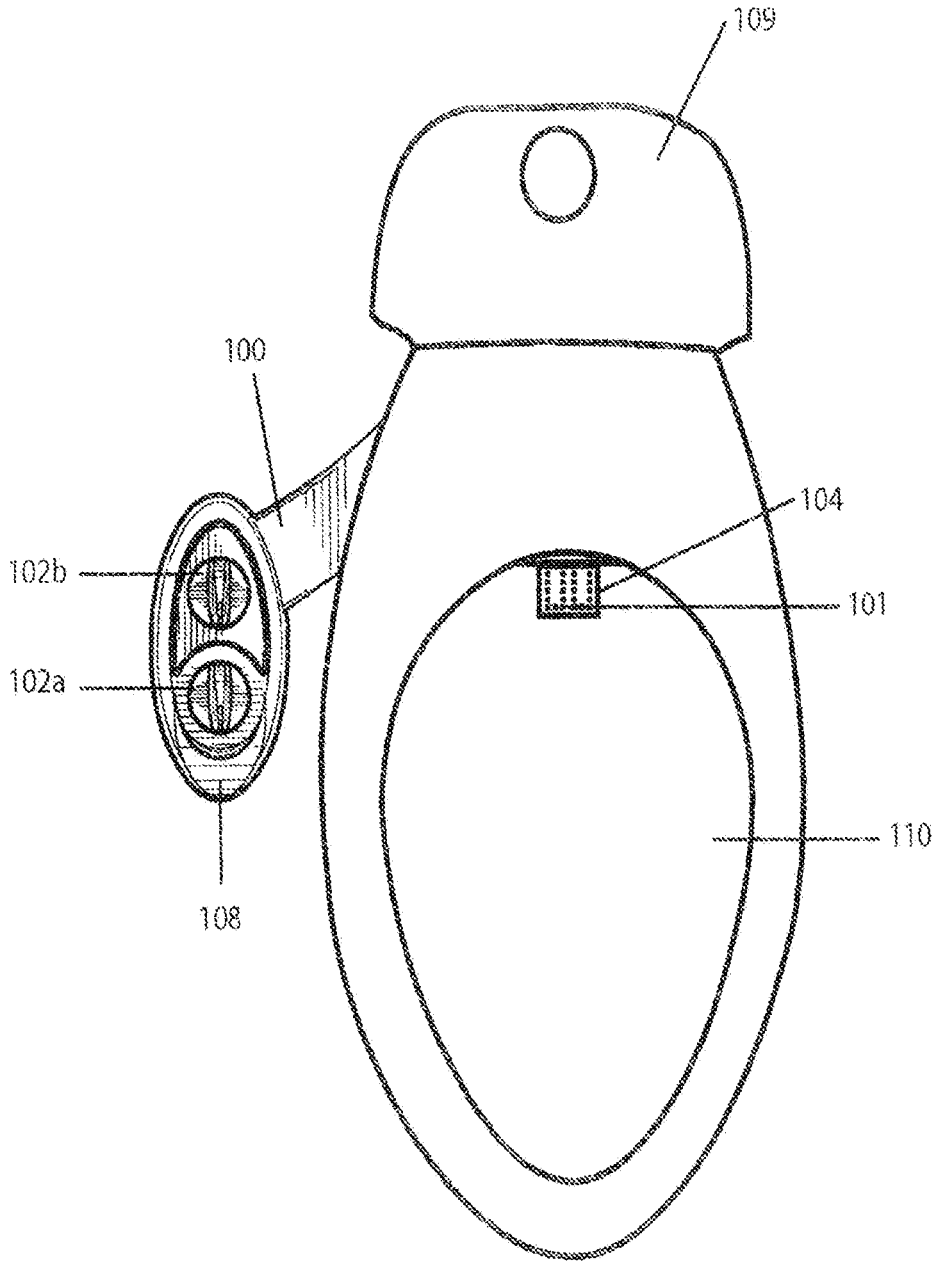
FIG. 2 illustrates an embodiment of a perspective view of a bidet washing apparatus installed on an existing toilet seat, with the seat cover down.

Referring to FIG. 1 and FIG. 2, the bidet washing apparatus 100 of the disclosure can be mounted on a toilet bowl 110 using securing mechanism 105*a* and 105*b*. Any conventional securing unit can be implemented, e.g., one or more screws. A toilet seat 112 can pivot around and can be connected to a rear portion of the toilet bowl 110. On the rear portion of the toilet bowl 110 can be mounted a refillable toilet tank 109, in which an amount of water can be stored. In certain embodiments, the toilet tank 109 can be used as the water source for the bidet washing apparatus 100 by a fluidic connection. On the bidet washing apparatus 100 can be mounted a nozzle assembly 101, which includes at least one washing nozzle (not shown) for washing the body parts of the user sitting on or near the toilet bowl 110. The body of bidet washing apparatus can be made of any suitable material, including but not limited to, plastics, polymers, reinforced polymeric materials, wood, metal and the like, and any combination thereof.

Figure 3:
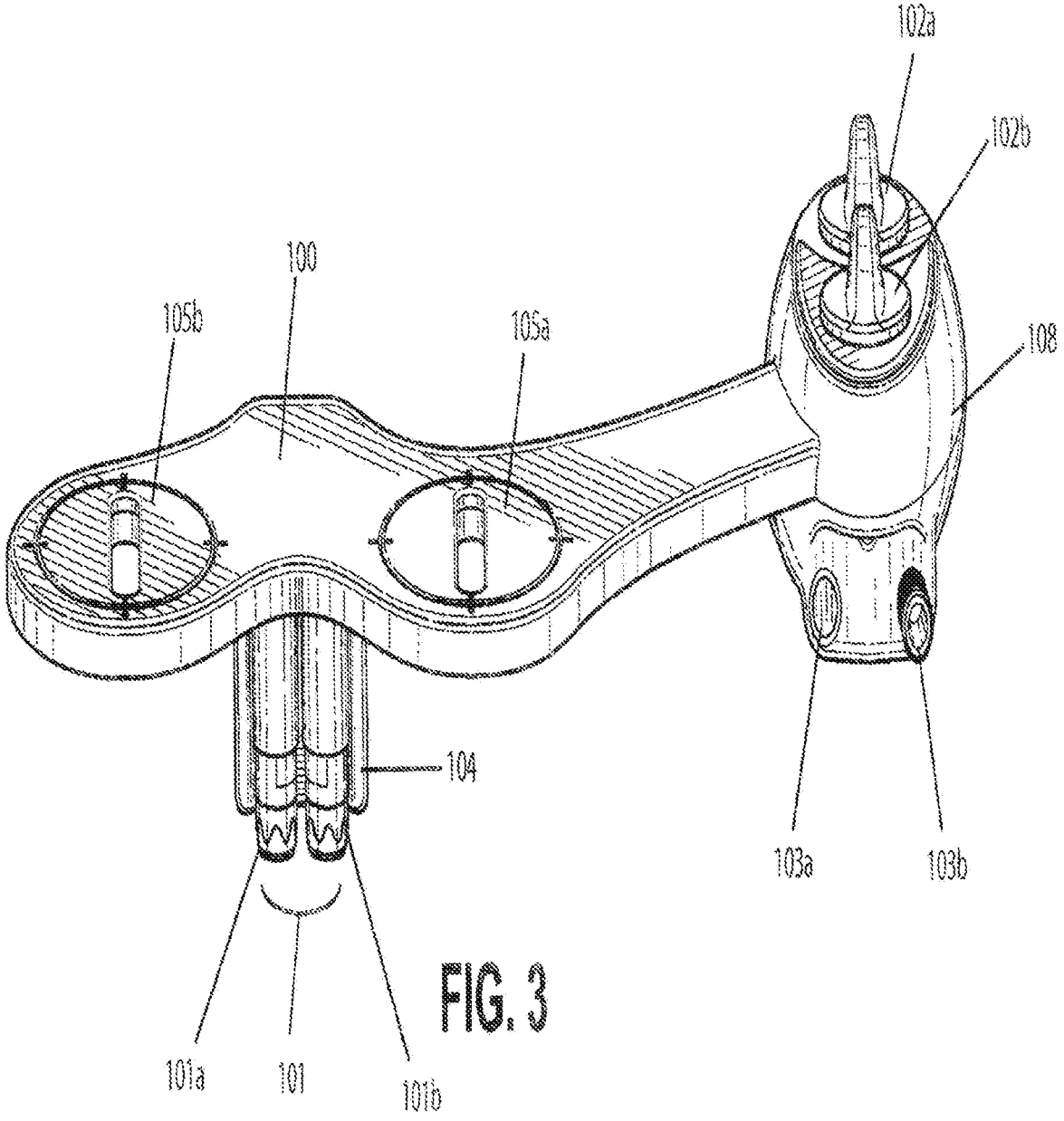
FIG. 3 illustrates an embodiment of a perspective view of an exemplary bidet washing apparatus.

FIG. 3 shows one exemplary embodiment of a bidet washing apparatus 100 with two washing nozzles 101*a* and 101*b*, respectively. However, in an installation a lesser or greater number of nozzles can be used. Each washing nozzle can spray a stream of water upwardly and inwardly, according to various embodiments.

As shown in FIG. 2 and FIG. 3, a control unit 108 can be provided the easy access for the user, and houses control switches 102*a* and 102*b* for providing operational instructions to the bidet washing apparatus 100. The depicted example shows two switches 102*a* and 102*b*; however, one of ordinary skill in the art would realize that any number of switches can be provided for performing various operations without departing from the scope of the disclosure. Some examples of operational instructions include, but are not limited to, controlling the flow of water from the water inlet, changing the angle of the washing nozzles, and opening and closing the protective shield gate (described in further detail below). The type of control switches can be selected from a group including knobs, dials, levers, and depressible buttons, or any conventional control mechanism, An installation may have all similar control switches where both control switches 102*a* and 102*b* are knobs.

Figure 9:
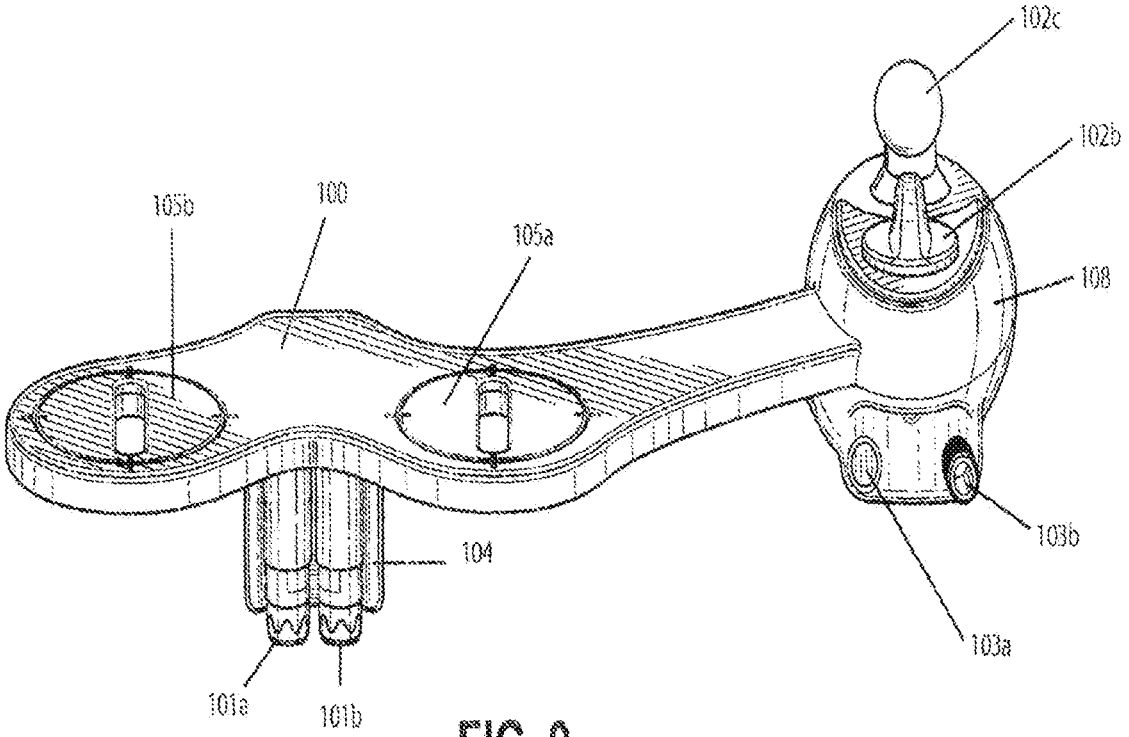
FIG. 9 illustrates an embodiment of a perspective view of an exemplary bidet washing apparatus.

On the other hand, FIG. 9 shows an embodiment of the disclosure where one of the control switches 102*b* is a knob and the other control switch 102*c* is a lever.

Furthermore, as shown in FIG. 1 and FIG. 2, the nozzle assembly 101 can have a protective shield gate 104 substantially or partially in front of it. The position of the protective shield gate 104 is such that it can act as a shield between the user's body and/or water in the toilet bowl 110 and the nozzle assembly 101 thus protecting the nozzle assembly 101 from pollutants during use.

Certain aspects of the bidet washing apparatus will be detailed hereinafter with reference to FIGS. 3-9.

FIG. 3 shows a front perspective view of one embodiment described herein. Referring to FIG. 3, the bidet washing apparatus 100 includes the water inlets 103*a* and 103*b* to feed water into the bidet. The water inlet can be controlled by the user using the control switches 102*a* and 102*b* situated on the control unit 108. The water from the water inlets 103*a* and 103*b* can be ultimately provided to the nozzle assembly 101 via tubes (as described in greater detail with reference to FIG. 7, for example). The nozzle assembly shown in this aspect of the disclosure has two washing nozzles 101*a* and 101*b*. The protective shield gate 104 protects the nozzle assembly 101 from excrement and pollutants as described above. In this example, the protective shield gate 104 is positioned in front of the nozzle assembly 101 of the bidet such that it is between the user sitting on the toilet seat, for example, and the nozzle assembly. Hence, when the user is using, the toilet, the nozzles are shielded behind the protective shield gate 104 and do not become polluted.

Figure 5:
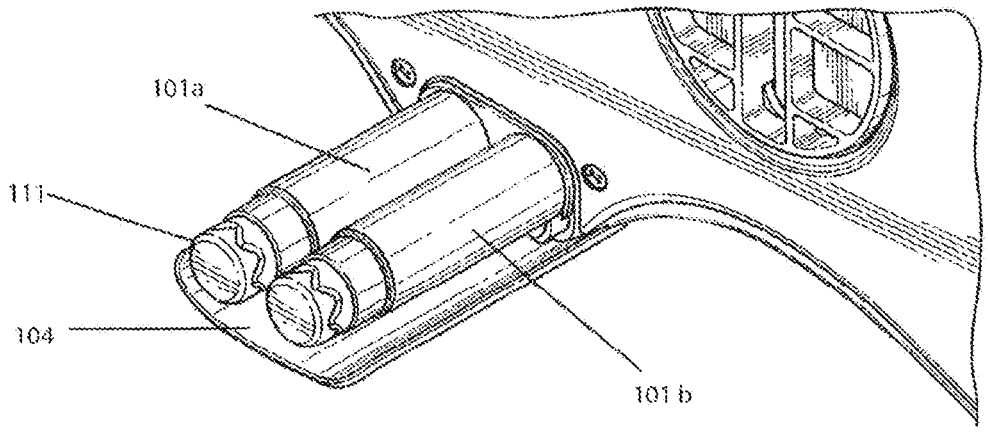
FIG. 5 illustrates an embodiment of a fragmentary view of an exemplary bidet washing apparatus illustrating the gate shield protecting the nozzle assembly in a closed position.
Figure 6:
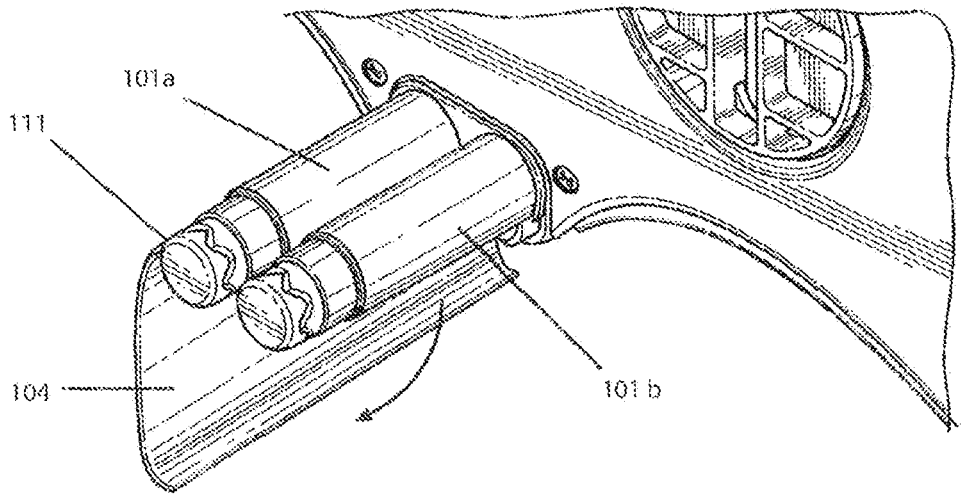
FIG. 6 illustrates an embodiment of a fragmentary view of an exemplary bidet washing apparatus illustrating the shield gate protecting the nozzle assembly in an open position.

Referring to FIGS. 5-6, the protective shield gate 104 can be movable along a hinged edge 111 to provide for further hygiene. The protective shield gate 104 rotates and thus can be manually, for example, opened (FIG. 6) and closed (FIG. 5), after using the toilet to clean any minute left over pollutants on the outer covering of the nozzle assembly to ensure complete cleanliness. In the embodiment, the user can open and close the gate manually and, thus, the gate can stay in the opened or closed position that the user places the gate. In certain embodiments, the gate can be opened and closed by an electrical signal using a control switch located on the control unit 108, which can allow the gate to remain open until the user closes the gate via the control switch, so the user can clean the nozzle. In other embodiments, the hinged edge 111 is on the top of the protective shield gate 104, and not, on the side edge as shown in the illustrative FIGS. 5-6. hi. yet other embodiments, the user may be able to completely remove the protective shield gate 104 for cleaning the nozzle(s) and reattach it after cleaning. Of course, one of ordinary skill in the art would understand that the hinged edge could comprise any rotatable joint mechanism that allows for, the rotation of the protective shield gate 104 to provide efficient access to the nozzle(s). If the protective shield gate 104 is completely removable, a grooved and slideable mechanism can be employed so that the protective shield gate 104 can slide in and out to be attached and removed. Of course, other mechanisms can be utilized for removably attaching the protective shield gate 104, e.g., a magnet or a snap structure.

In certain embodiments, the protective shield gate 104 has a flap portion perpendicular to the protective shield gate 104 such that it covers the bottom of the nozzle assembly 101. Additionally, the flap can have a spring mechanism such that it is pushed out and aligns with the protective shield gate 104 by the force of the water stream when water flows out of the nozzle assembly 101. When the water flow stops, the flap can spring hack into its original position perpendicular to the shield gate 101.

The protective shield gate 104 of the disclosure can be made from a material selected from plastic, metal, material having anti-microbial properties, and material with increased pollutant repellant properties.

In certain embodiments, the angle of the washing nozzles can be adjusted using control switch located on the control unit 108. Thus, when a user wants to clean certain body parts, water can be sprayed on a desired body part by adjusting the angle of the washing nozzle(s). As shown in FIG. 3, the height of the protective shield gate is such that it allows for an uninterrupted spray of water from the nozzle assembly 101, since the nozzle assembly 101 can extend beyond the bottom edge of the protective shield gate 104.

Figure 4:
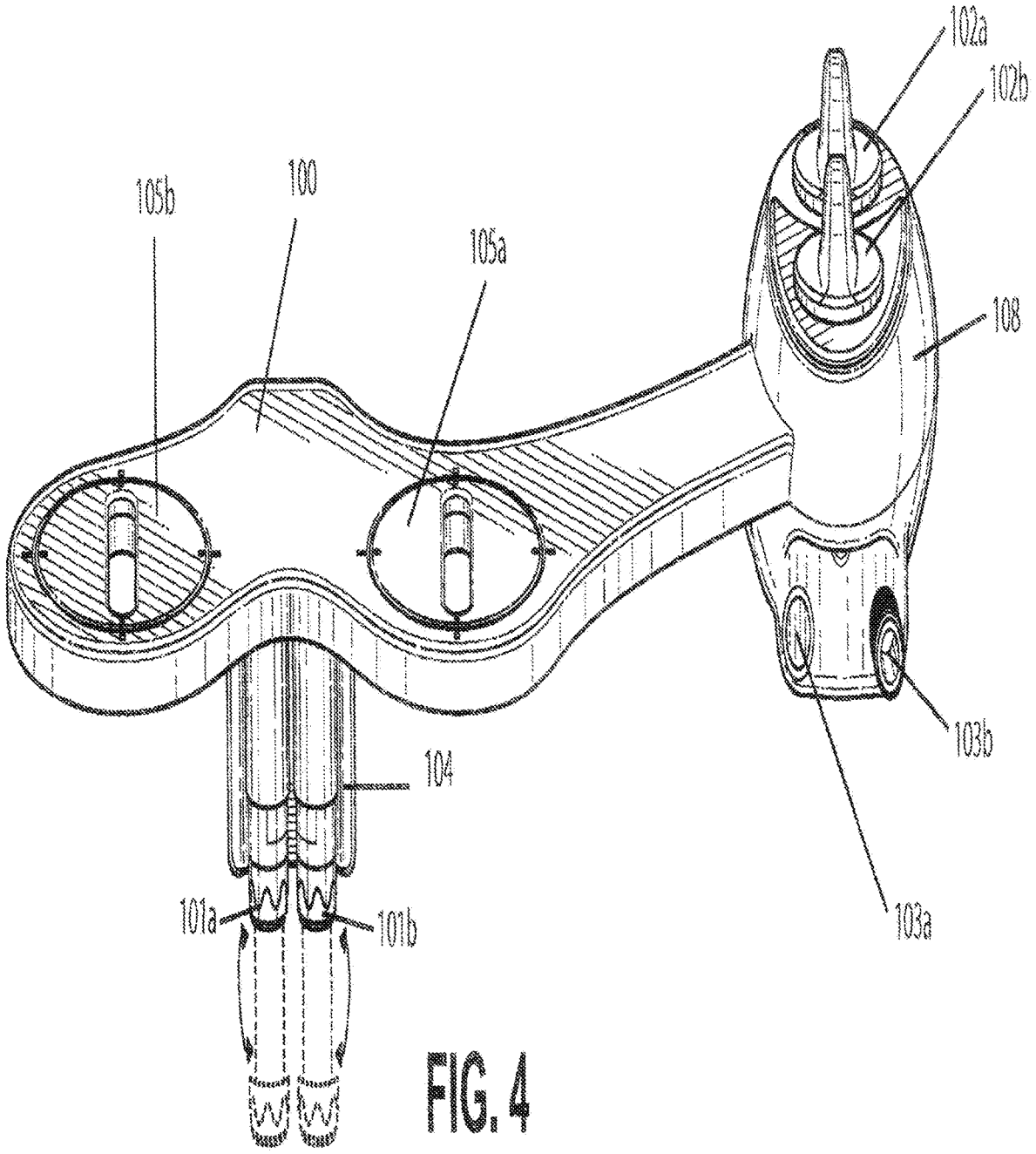
FIG. 4 illustrates an embodiment of a perspective view of an exemplary bidet washing apparatus, with the dotted lines showing the nozzles extended outwards.

FIG. 4 shows another embodiment wherein the height the protective shield gate is equal to or greater than that of the washing nozzles 101*a* and 101*b*. Here, the washing nozzles 101*a* and 101*b* are housed within an outer covering including a spring mechanism for pushing the washing nozzles out when water flows through the washing nozzles such that the water flow is not interrupted by the protective shield gate 104. Each washing nozzle includes an outer covering and as inner nozzle operated slidably hack and firth with hydraulic pressure of the supplied washing water in accordance with an instruction from the control unit 108. During use of the washing nozzles, the nozzles are extended from their outer covering below the length of the shield gate by the hydraulic force of the washing water and water is sprayed on the user for cleaning purposes. After use, when the water flow is stopped, the nozzles are retracted in their outer covering which is hidden behind the shield gate. In certain other embodiments, the user may control the movement of the washing nozzle by using the control unit 108, instead of the hydraulic pressure. When an instruction of a washing operation is given by the control unit 108, a washing nozzle driving unit is activated to advance the nozzle. The washing nozzle angle can also be adjusted by an instruction given by the control unit 108 to position the nozzle for cleaning. Thus, the washing nozzle can reach the user's desired washing position by the combined advancement of the nozzle and/or the angular positioning.

According to the embodiment, the nozzle assembly 101 includes at least one washing nozzle in yet another embodiment, the bidet washing apparatus 100 further includes a self-cleaning cleaning nozzle for cleaning the nozzle assembly itself. The self-cleaning nozzle can be positioned to spray water onto the nozzle assembly 101 and/or washing nozzle(s) before and/or after usage for additional hygiene. The self-cleaning nozzle can be adapted to be controlled by the control unit 108, and thus provides an additional hygiene level.

Another embodiment includes a toilet cleaning nozzle fur cleaning the toilet and the bidet before and after use of the toilet. The toilet cleaning nozzle can be positioned to spray water on the toilet bowl 110 and/or the bidet washing apparatus 100 and can be controlled by the control unit to provide additional hygiene. Yet, another embodiment includes a shield cleaning nozzle for cleaning the protective shield gate 104. The shield cleaning nozzle can be similarly controlled by the control unit 108. Additionally, the shield cleaning nozzle can be positioned to clean the protective shield gate 104 in an open and/or closed position.

Any or all of the washing nozzles can be connected to the nozzle assembly 101 via a ball joint, for example, which could allow the user to manually swivel a washing nozzle around 360 degrees, in order to direct the spray of water in a desired and precise direction. Of course, other types of joints and connectors could be implemented in order to allow for the manual swivel or direction correction, as desired by the user to spray water to a desired body part, for example.

Moreover, according to an exemplary embodiment, e or more of the washing nozzle(s) 101*a* and 101*b* can be connected to the nozzle assembly 101 by a mechanism allowing for the easy removal of the nozzle(s) 101*a* and 101*b*. For example, the washing nozzle(s) 101*a* and 101*b* can slide into place via a grooved portion of the nozzle assembly 101 or could otherwise snap into place. Any conventional mechanism of removably attaching the nozzle(s) 101*a* and 101*b* can be implemented, so that the user can swap the nozzle(s) 101*a* and 101*b* with other nozzles or increase or reduce the number of washing nozzle(s) 101*a* and 101*b* connected to the nozzle assembly 101.

Figure 7:
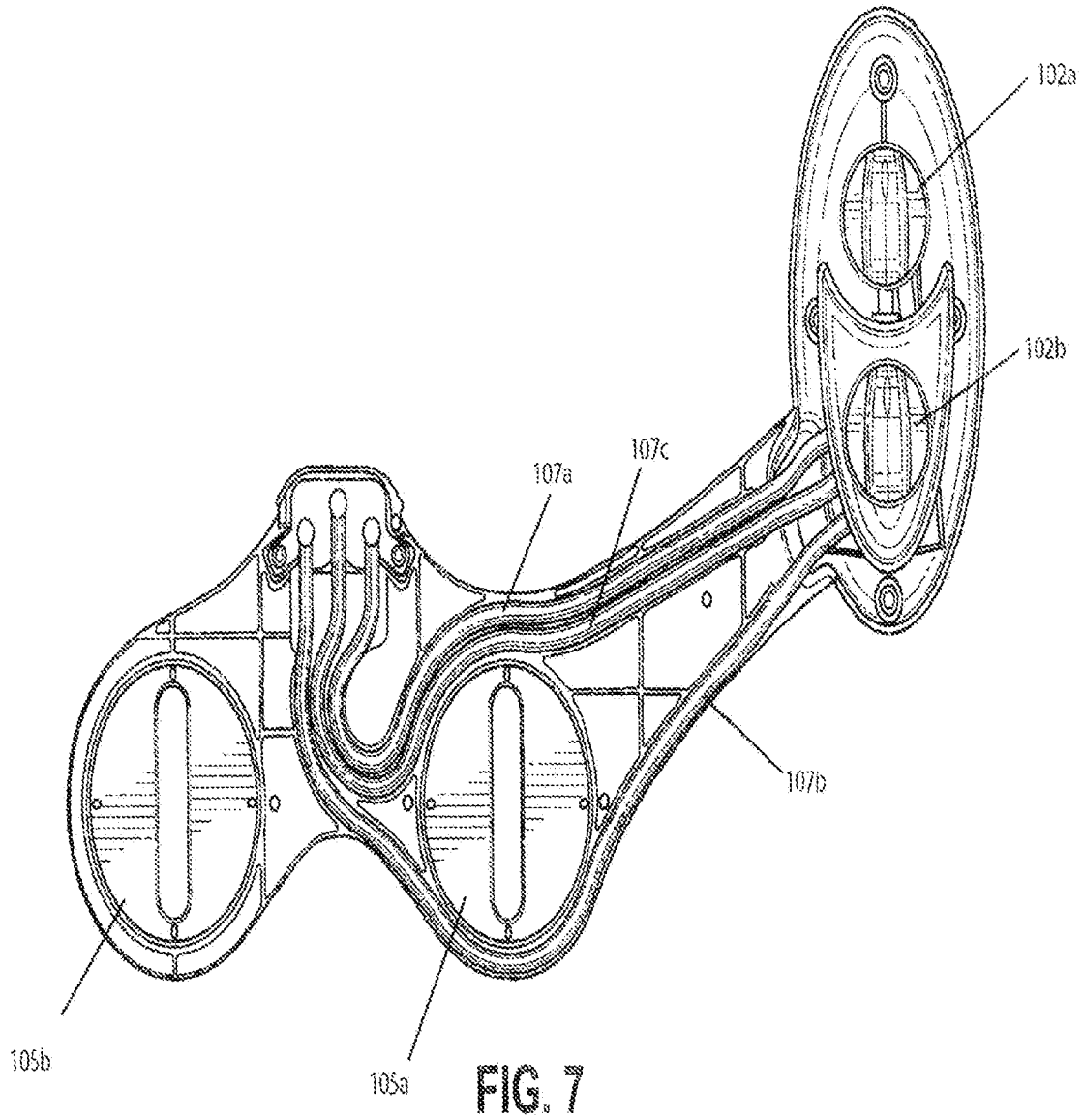
FIG. 7 illustrates an embodiment of a top plan view of the exemplary embodiment.
Figure 8:
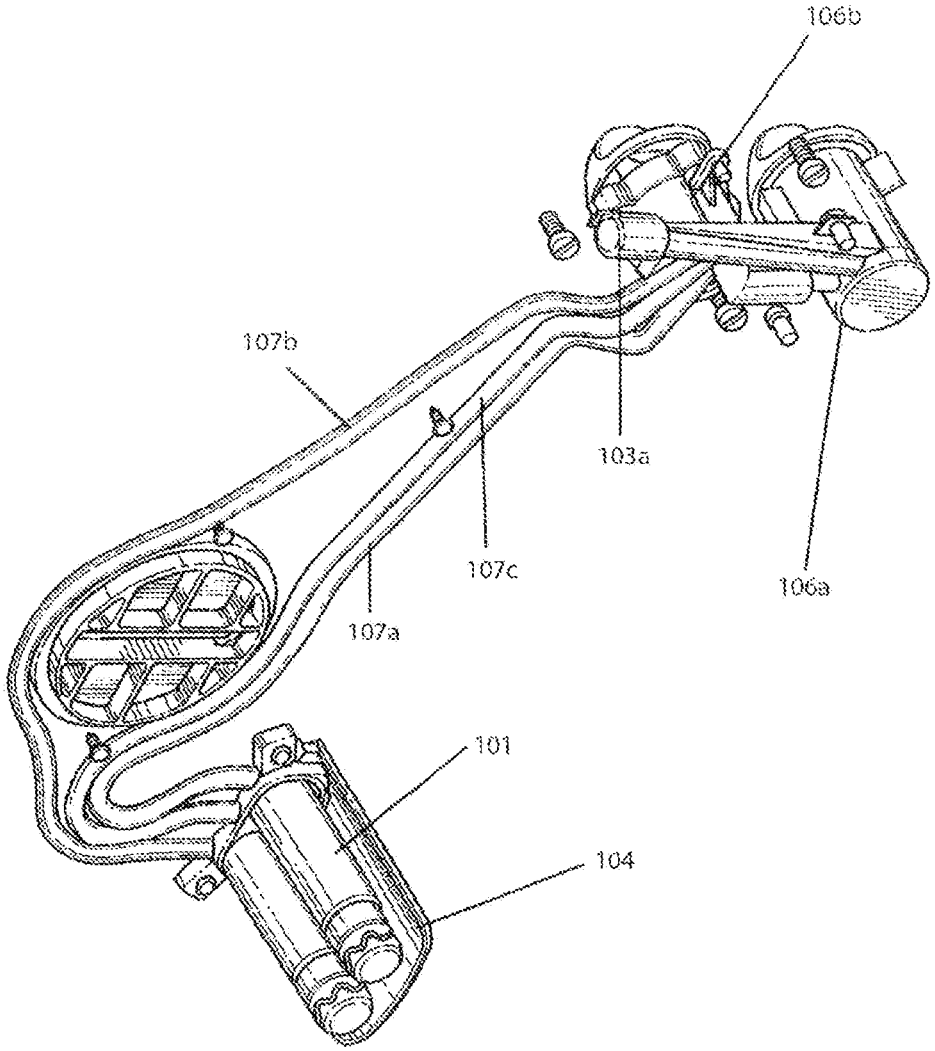
FIG. 8 illustrates an embodiment of a bottom plan view of a perspective view of a bidet washing apparatus.

An exemplary water supply system to the nozzle assembly 101 will be detailed hereinafter with reference to FIGS. 7-8. The control unit 108 can house the control valves 106*a* and 106*b* (as shown in FIG. 8), to control the flow of water to the water tubes and has the control switches 102*a* and 102*b*, for giving instructions to the control valves. Two control valves and control switches are depicted for exemplary purposes, but it should be understood that any number of control valves and corresponding switches can be employed.

The control valves 106*a* and 106*b* can be situated at the entrance to the water tubes 107*a*, 107*b*, and 107*c* in this example. The control valves 106*a* and 106*b* are designed to open, close or partially obstruct the water inlet 103*a* opening into the water tubes 107*a*, 107*b* and 107*c*, such that the volume of the water flowing through the any tube at any given time can be easily controlled by the user by giving simple instructions thorough the control switches. The water tubes 107*a*, 107*b*, and 107*c* connect the control valves 106*a* and 106*b* at one end to the nozzle assembly 101 at the other end. Thus, the control valves 106*a* and 106*b* can effectively control the volume of water flowing to the nozzle assembly 101. In the embodiment, one water tube 107*b* passes through the back of the bidet washing apparatus 100, and two water tubes 107*a* and 107*c* pass through the front of the bidet washing apparatus 100. However, it is to be noted that in an embodiment, more than one water tube could pass through the back of the bidet washing apparatus 100, and the number of water tubes passing through the front of the bidet washing apparatus 100 could be more or less than two.

According to an embodiment, the bidet washing apparatus 100 can include a vacuum breaker (not depicted), which can be situated at various locations within the bidet washing apparatus 100. The vacuum breaker can be located anywhere between the water supply (e.g., the water tank supplying water to the toilet bowl) and the washing nozzle(s) e.g., 101*a* and 101*b*) output. The vacuum breaker can be intended to halt the flow of water that is not expelled by the washing nozzle(s) back into the water supply. According to one exemplary embodiment, the vacuum breaker(s) can be housed within the control unit 108, located between a valve 106*a* and 106*b* and the nozzle assembly 101; however, one of ordinary skill in the art would realize that various locations of one or more vacuum breakers can be implemented within the scope of this disclosure to perform the desired function.

Figure 10:
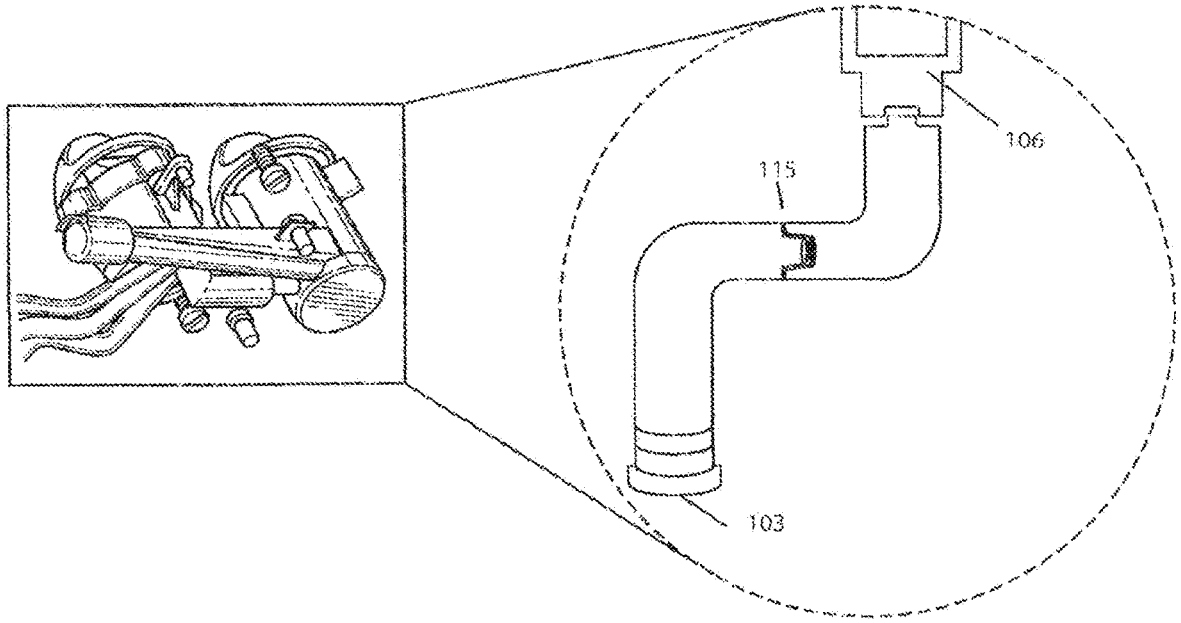
FIG. 10 illustrates an embodiment of a schematic showing a single connection between a water inlet and a control valve inside a control, panel.

In one exemplary embodiment, each water inlet 103*a* and 103*b* is connected to a control valve 106*a* and 106*b* by a single, non-jointed, connection 115 (see FIG. 10) thereby removing any intervening parts and extra connections, which can considerably increase the durability and lifetime of the bidet system. Of course, multiple water inlets 103*a* and 103*b* could be connected to a single control valve; however, each connection between the water inlets 103*a* and 103*b* and the single control valve can be a single-body structure, according to one embodiment.

In an embodiment, the washing nozzle can be replaced with a nozzle that is configured to hold materials such as soap, disinfectant or any cleaning or medicinal, substance that can be expelled along with water as it flows through the nozzle. For example, such materials could be in a solid, semi-solid or liquid form, which dissolves at a predetermined and desired rate, as the water flows through the nozzle and is carried out of the nozzle by the spraying water.

In another embodiment, the bidet washing apparatus can contain one or more reservoir dispensers or chambers, which can be configured to hold materials such as soap, disinfectant or any cleaning or medicinal substance that can be expelled along with water through one or more water tubes to the nozzle assembly and car be carried out of one or more nozzles by the spraying water. As before, the above-mentioned materials are provided merely for exemplary purposes and are not intended to limit the disclosure in any way. Other known substances and/or materials could be held and/or stored in a nozzle or reservoir dispenser in order to be expelled with water through the nozzle.

Figure 11:
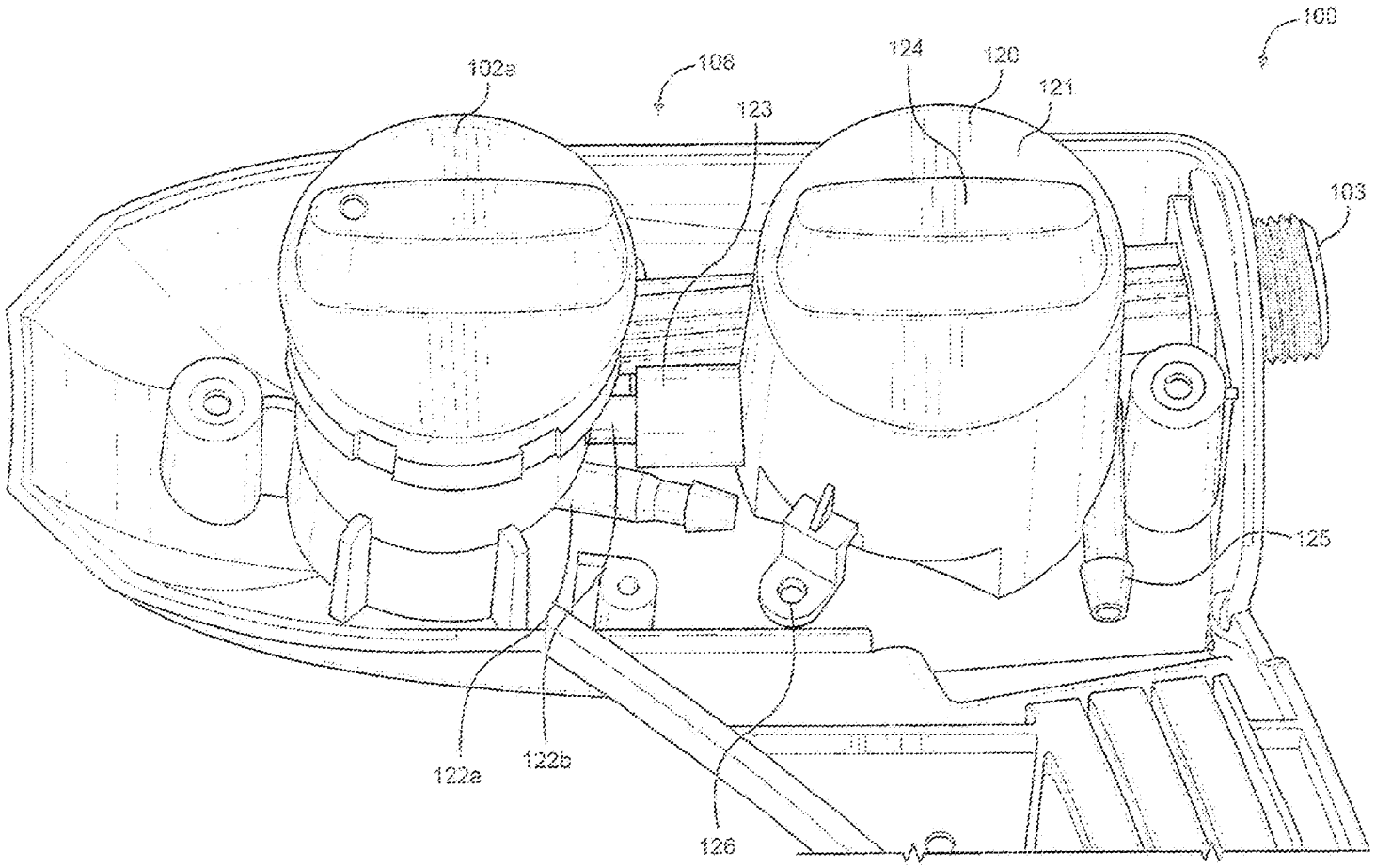
FIG. 11 illustrates a cut-away view fan embodiment of a top view of a bidet washing apparatus.

FIG. 11 illustrates a cut-away view of an embodiment of atop view of a bidet washing apparatus 100, i.e., without showing the entire body of the apparatus. In this figure, the apparatus includes water inlet 103*a*, which is fluidically connected to control unit 108 to supply water. The control unit includes control unit switch 102*a*, which is configured to operate one or more control unit valves or openings (not shown) for controlling water flow from the water inlet and from control unit outlets 122*a* and 122*b*.

As shown, the apparatus also includes a reservoir dispenser 120 having one or more compartments (not shown) with a removable lid 121 for holding soap and/or disinfectant. The control unit outlets, 122*a* and 122*b*, allow for transfer of water from the control unit to the nozzle assembly 101 via water tube 107*a* and/or 107*c* (see FIGS. 3-9); and to the reservoir dispenser 120 via reservoir dispenser inlet 123, respectively.

The reservoir dispenser 120 allows for mixing of the transferred water with the soap and/or disinfectant present in the one or more compartments of the dispenser to provide a soapy and/or a disinfectant solution or mixture. The reservoir dispenser 120 includes reservoir dispenser switch 124, which is configured to operate one or more reservoir dispenser valves or openings (not shown) for controlling water flow from the control unit and/or from reservoir dispenser outlet 125.

Once mixed together, the solution or mixture in the one or more compartments of the reservoir dispenser 120 can be transferred through the reservoir dispenser outlet 125 to the nozzle assembly 101 via water tube 107*a*, 107*b* or 107*c* (see FIG. 9), and provide the solution or mixture for washing and cleaning the nozzle assembly and shield gate.

Also shown in this figure is a plurality of tabs with openings 126, which can be used as a securing mechanism for securing the control unit and reservoir dispenser to the body of the apparatus using screws, bolts, or snaps, and the like.

Figure 12:
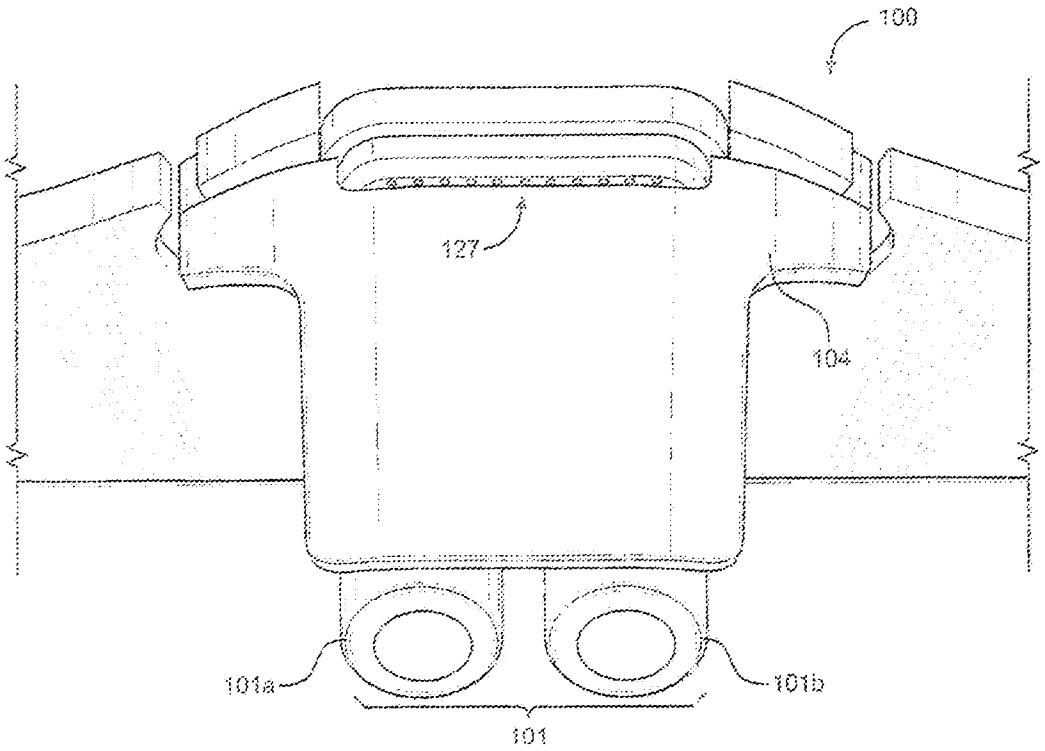
FIG. 12 illustrates a cut-away view of an embodiment of a bottom view of a bidet washing apparatus, showing nozzle assembly including washing nozzles and a shield gate.

FIG. 12 illustrates a cut-away view of an embodiment of a bottom view of a bidet washing apparatus 100, showing nozzle assembly 101 including washing nozzles 101*a* and 101*b*, and protective shield gate 104. This figure also illustrates one or more water openings 127 located above the nozzle assembly, which allow the solution or mixture transferred through water tube 107*a*. 107*b* or 107*c* to wash and/or clean the nozzle assembly and shield gate.

Figure 13A:
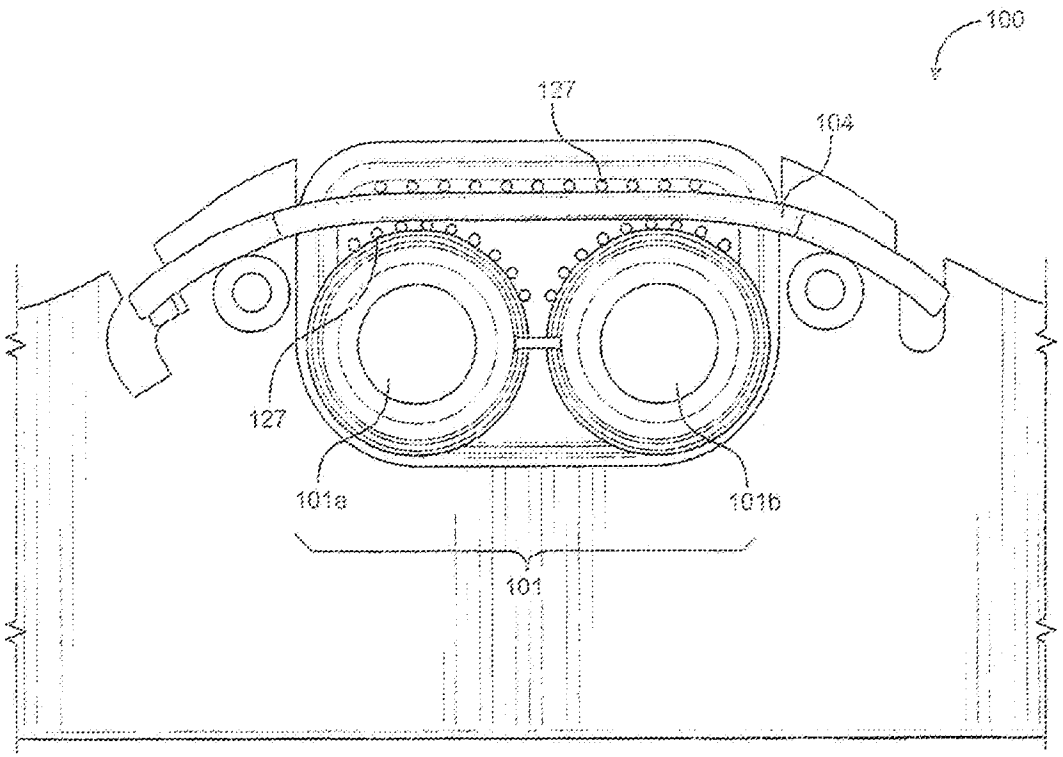
FIGS. 13*a* and 13*b* illustrate a cut away view of an embodiment of a bottom view of the nozzle assembly, washing nozzles, and the one or more openings with and without a shield gate.
Figure 13B:
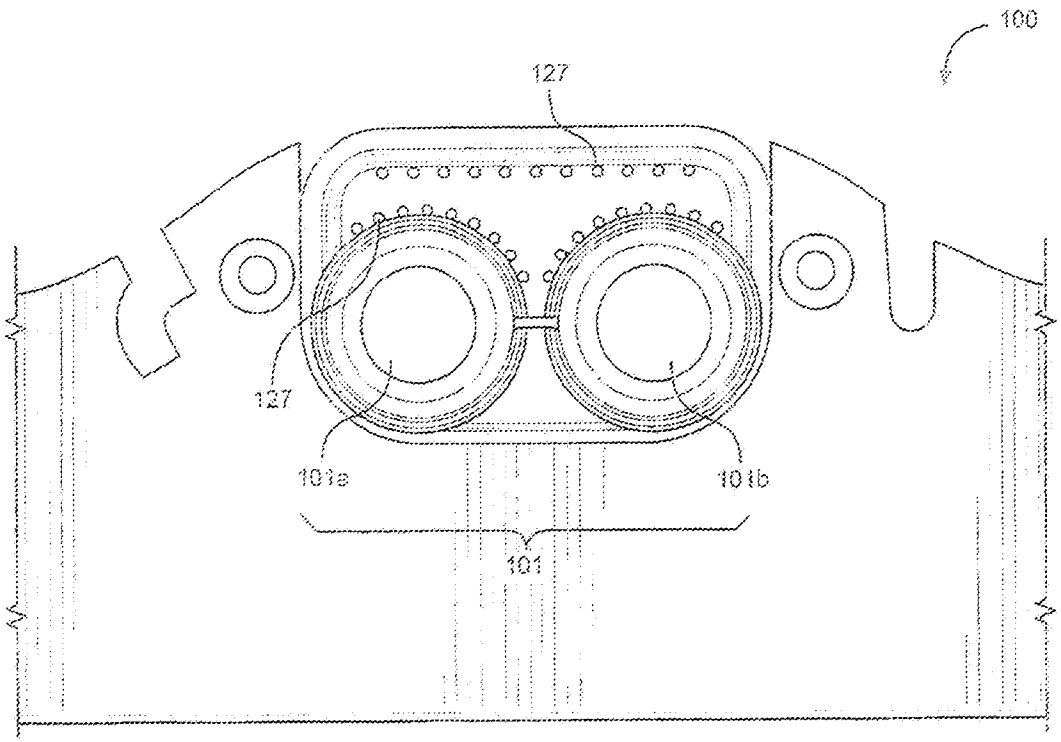

FIGS. 13*a* and 13*b* illustrate a cut-away view of an embodiment of a bottom view of the nozzle assembly 101, washing nozzles 101*a* and 101*b*, and the one or more water openings 127 with and without the protective shield gate 104, respectively. As shown in these figures, the one or mote openings can be configured to wash one or both sides of the shield gate.

Figure 14:
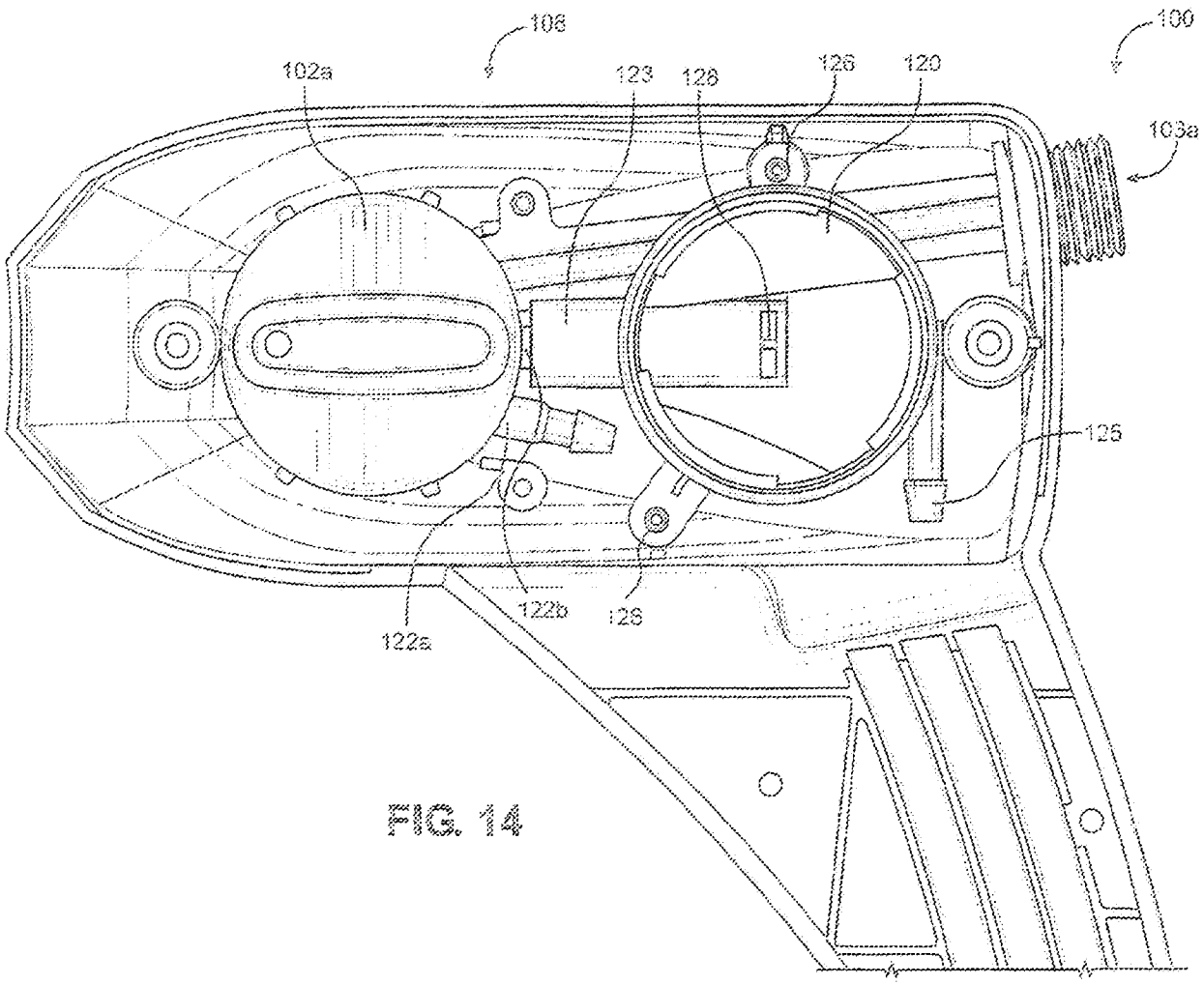
FIG. 14 illustrates a cut-away view of an embodiment of a top view of a bidet washing apparatus, showing a one compartment reservoir dispenser with the lid removed.

FIG. 14 illustrates a cut-away view of an embodiment of a top view of a bidet washing apparatus 100, showing a one compartment reservoir dispenser 120 with the lid removed.

As shown, inside the reservoir dispenser 120 is an opening 128 in the reservoir dispenser inlet 123, which allows for flow of water from the control unit switch 102*a* into the compartment of the reservoir dispenser.

Also shown in this figure is the water inlet 103*a*, control unit 108, control unit outlets 122*a* and 122*b*, reservoir dispenser inlet 123 reservoir dispenser outlet 125, and securing mechanisms 126.

Figure 15:
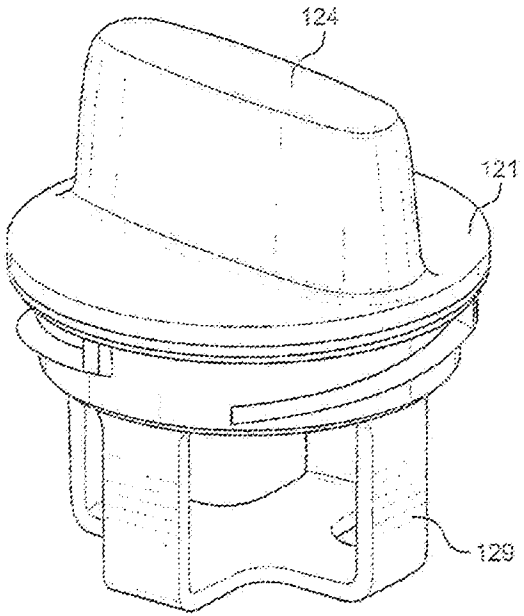
FIG. 15 illustrates a view of the lid, which can be removably attached to the reservoir dispenser.

FIG. 15 illustrates a view of the lid 121, which can be removably attached to the reservoir dispenser. The lid 121 can include the reservoir dispenser switch 124 and a lower securing gate 129 for securing cleaning and/or disinfection materials in solid or tablet form. Alternatively, the lower securing gate can include one or more filters or screens for securing the cleaning material, which can allow water to flow over the cleaning and/or disinfection materials to provide the desired solution.

The reservoir dispenser and lid can be of any type of complimentary securing device to make up the dispenser, e.g. a threaded dispenser and screw-on lid, a dispenser with a snap-on lid, etc. In addition, the dispenser and or lid can include one or more washers or O-rings (not shown), or any other similar type of device for securing a water-tight seal between the dispenser and lid.

Figure 16:
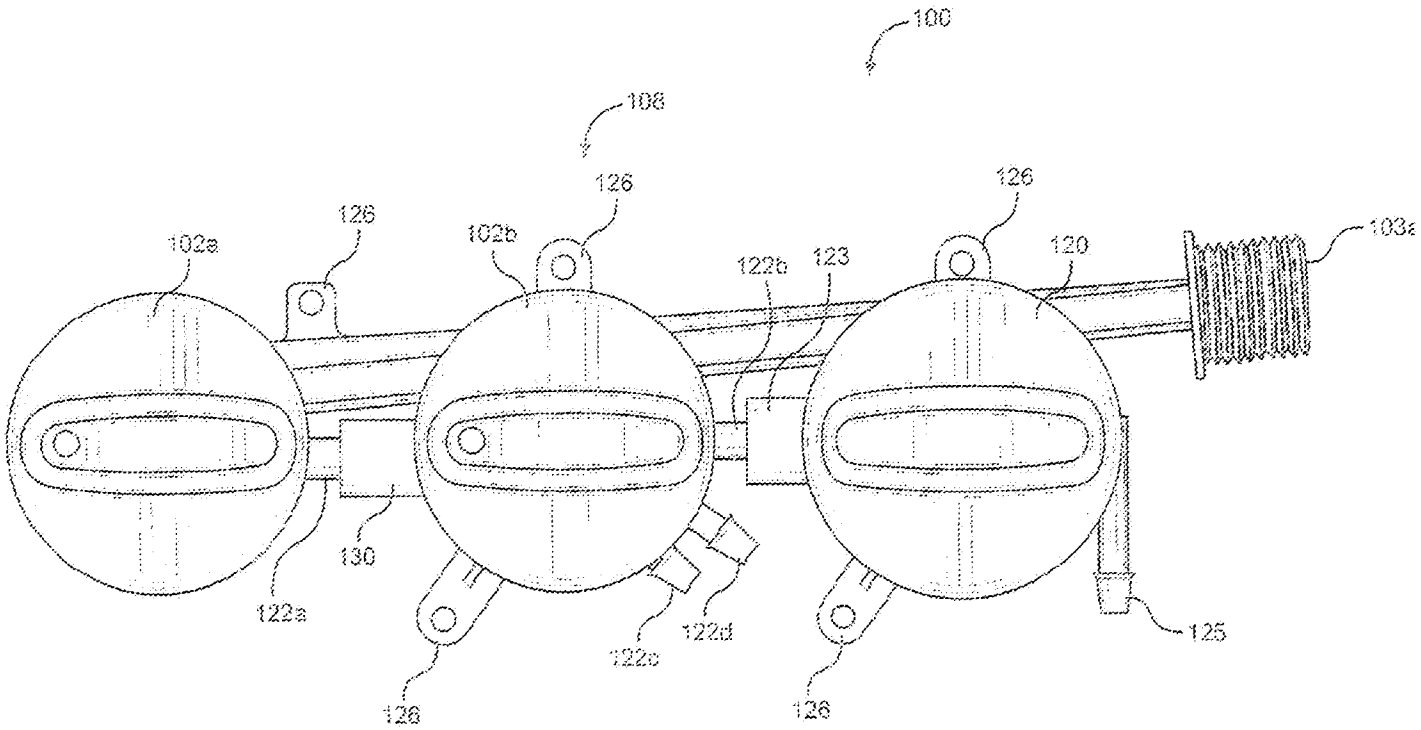
FIG. 16 illustrates a cut-away view of an embodiment of a bidet washing apparatus with a reservoir dispenser and, a removable lid.

FIG. 16 illustrates a cut-away view of an embodiment of a bidet washing apparatus 100 with a reservoir dispenser 120 and a removable lid 121. In this figure, the apparatus includes water inlet 103*a* connected to control unit 108 having control switch 102*a*. The first control switch can act as, an on/off switch for the incoming and out-going water. In the on position, water can be transferred from the first control switch to control switch 102*b* via control unit outlet 122*a* and control unit inlet 130. Control switch 102*b* includes two water outlets 122*c* and 122*d* for transferring water to the nozzle assembly 101 via water tubes 107*a*, 107*b* or 107*c*. Control switch 102*b* also includes a water outlet 122*b*(not shown) for transferring water to the reservoir dispenser 120 via reservoir dispenser inlet 123. Ultimately, the resulting solution or mixture in the reservoir dispenser can be transferred, to nozzle assembly 101 for cleaning purposes via reservoir dispenser outlet 125 and water tube 107*a*, 107*b* or 107*c* (not shown).

Figure 17:
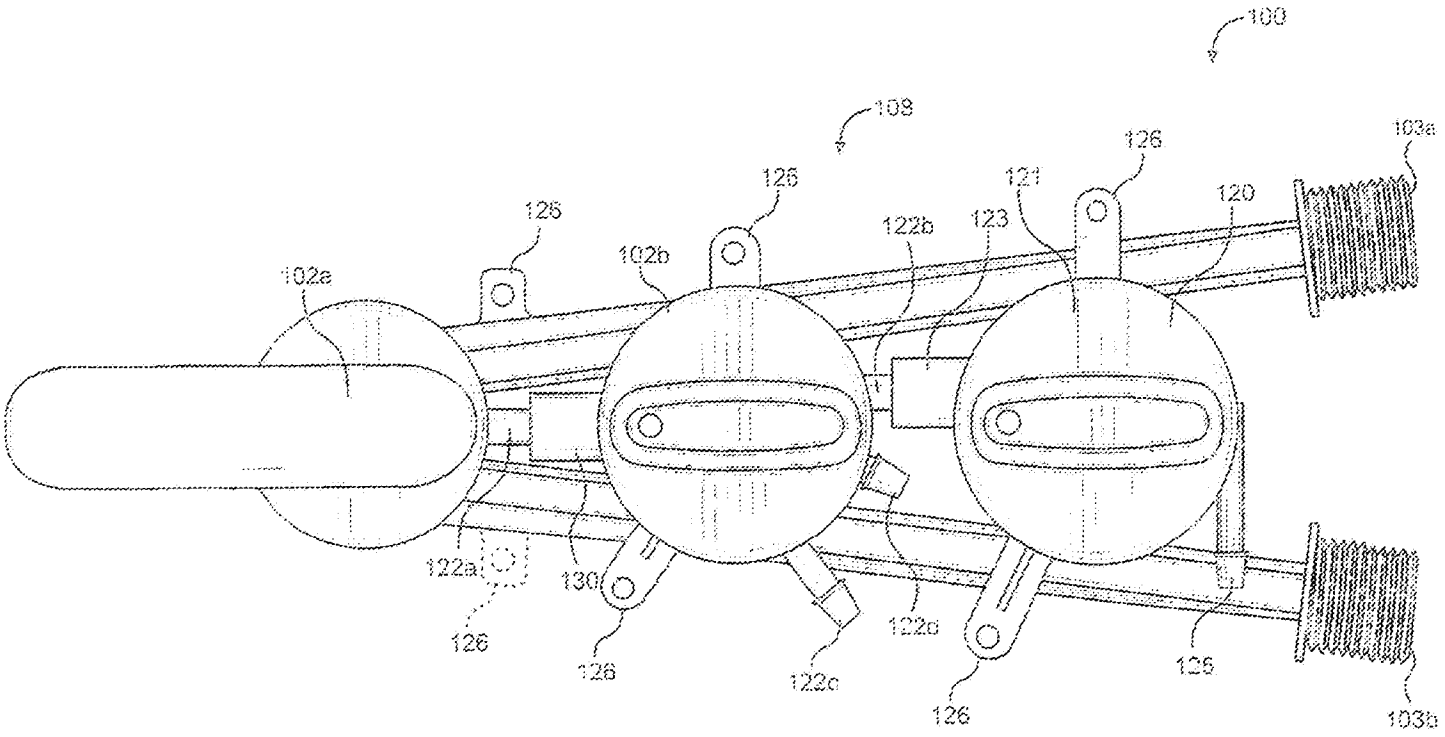
FIG. 17 illustrates a cut-away view of an embodiment of a bidet washing apparatus with a reservoir dispenser and a removable lid.

FIG. 17 illustrates a cut-away view of an embodiment of a bidet washing apparatus 100 with a reservoir dispenser 120 and a removable lid 121. In this figure, the apparatus includes separate water inlets 103*a* and 103*b*, which can be used for transporting cold and/or hot water to the control switch 102*a*. The apparatus also includes water inlet 103*a* connected to control unit 108 having control switch 102*a*, which can be configured as a handle or lever. As before, the first control switch can act as an on/off switch for the incoming and out-going water. In the on position, water can be transferred from the first control switch to control switch 102*b* via water outlet 127*a* and water inlet 130. Control switch 102*b* includes two water outlets 122*c* and 122*d* for transferring water to the nozzle assembly 101 via water tubes 107*a*, 107*b* or 107*c*. Control switch 102*b* also includes a water outlet 122*b* (not shown) for transferring water to the reservoir dispenser 120 via reservoir dispenser inlet 123. Ultimately, the resulting solution or mixture in the reservoir dispenser can be transferred to nozzle assembly 101 for cleaning purposes via reservoir dispenser outlet 125 and water tube 107*a*, 107*b* or 107*c* (not shown).

Figure 18:
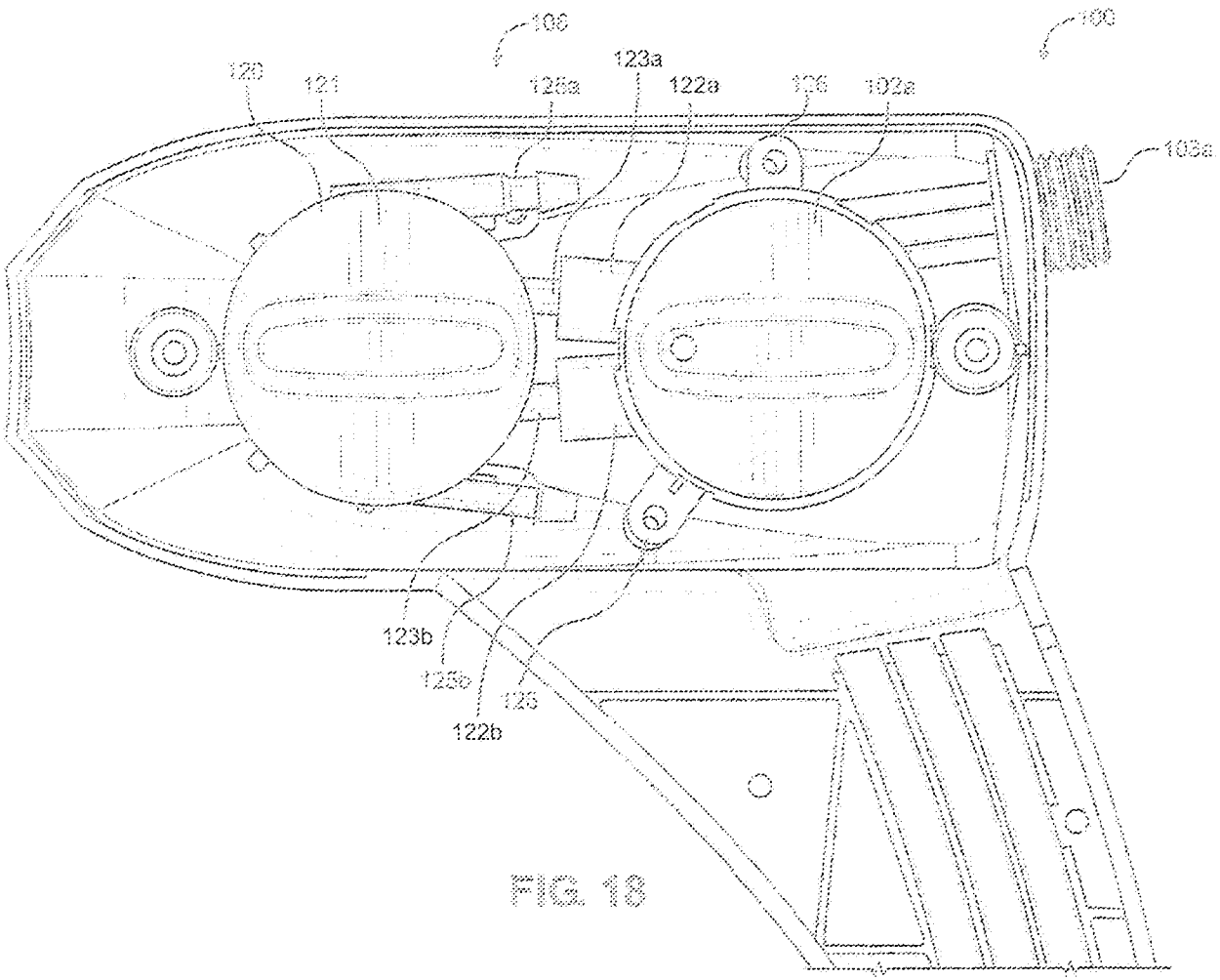
FIG. 18 illustrates, a cut-away view of an embodiment of a bidet washing apparatus with a reservoir dispenser and a removable lid.

FIG. 18 illustrates a cut-away view of an embodiment of a bidet washing apparatus 100 with, a reservoir dispenser 120 and a removable lid 121. In this figure, the apparatus includes water inlet 103*a* or 103*b* connected to control unit 108 with control switch 102*a*. In the on position, water can be independently transferred from control unit 108 to the reservoir dispenser 120 via first water outlets 122*a* and 122*b* (now shown) and reservoir dispenser inlets 123*a* and 123*b*, respectively. Here, the reservoir dispenser 120 includes two separate compartments 120*a* and 120*b* (see, FIG. 19), in which each compartment can independently contain soap and/or disinfectant. The resulting solution and mixture in each of these compartments can be transferred to nozzle assembly 101 for cleaning purposes via the reservoir dispenser switch 124, reservoir dispenser outlets 125*a* and 125*b* and water tubes 107*c* and 107*d* (not shown), respectively.

Figure 19:
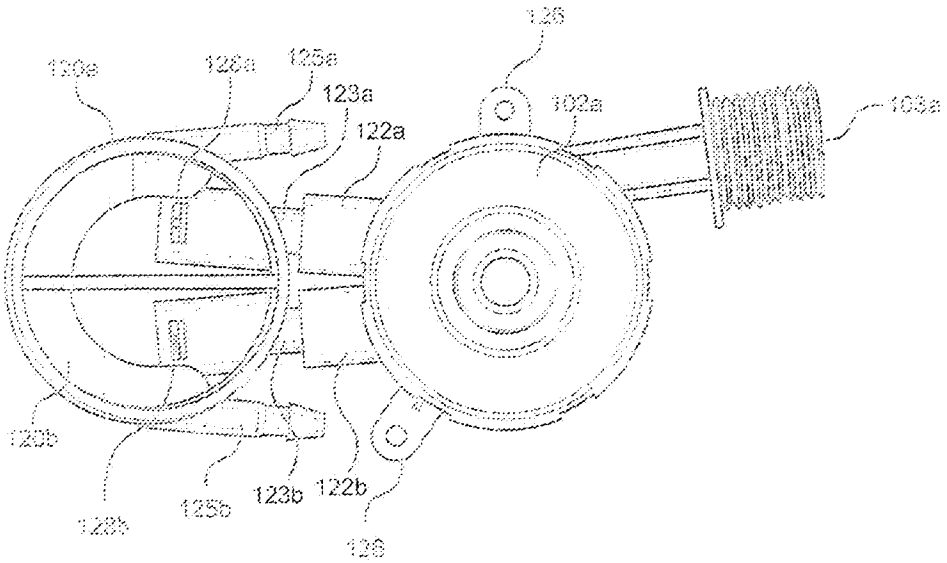
FIG. 19 illustrates a cut away view of an embodiment of a bidet washing apparatus with a reservoir dispenser without the removable lid.

FIG. 19 illustrates a cut-away view of an embodiment of a bidet washing apparatus 100 with a reservoir dispenser 120 the removable lid removed. In this figure, the apparatus includes water inlet 103*a* or 103*b* connected to control unit 108 with control switch 102*a*, in the on position, water can be independently transferred from control unit 108 to the reservoir dispenser 120 via first water outlets 122*a* and 122*b* (now shown) and reservoir dispenser inlets 123*a* and 123*b*, respectively. Here, the reservoir dispenser 120 includes two separate compartments 121*a* and 121*b*, in which each compartment can independently contain soap and/or disinfectant. The resulting solution or mixture in each of these compartments can be transferred to nozzle assembly 101 for cleaning purposes via the reservoir dispenser switch 124, reservoir dispenser outlets 125*a* and 125*b* and water tubes 107*e* and 107*d* (not shown), respectively.

Figure 20:
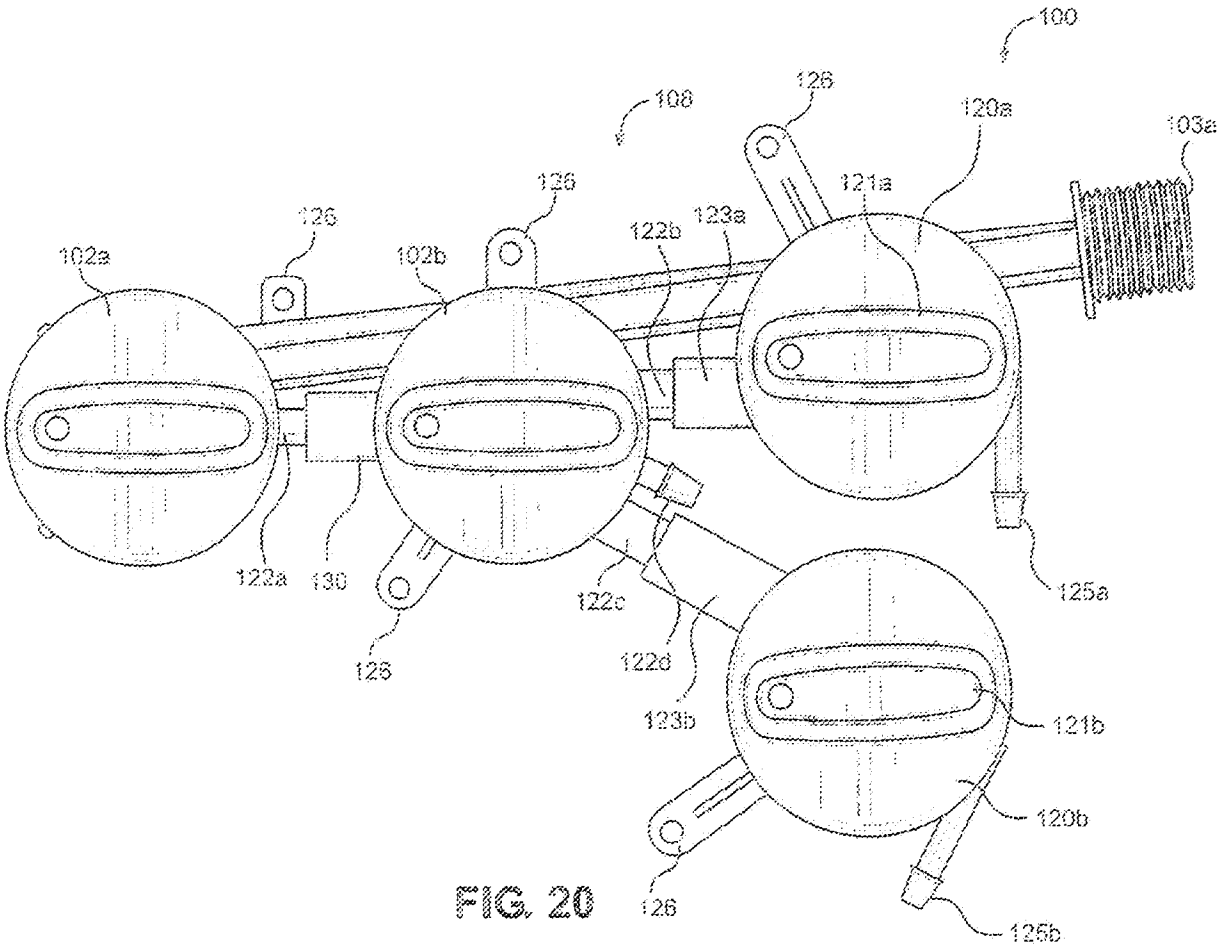
FIG. 20 illustrates a cut-away view of an embodiment of a bidet washing apparatus with two reservoir dispensers with removable lids.

FIG. 20 illustrates a cut-away view of an embodiment of a bidet washing apparatus 100 with a reservoir dispensers

120*a* and 120*b* with a removable lid 122*a* and 120*b*, respectively. In this figure, the apparatus includes water inlet 103*a* connected to control unit 108 with control switch 102*a*. Control switch 102*a* can act as an on/off switch for the incoming and out-going water. In the on position, water can be transferred from control switch 102*a* to control switch 102*b* via water outlet 122*a* and water inlet 130. Control switch 102*b* includes water outlet 122*b* for transferring water to the reservoir dispenser 120 via reservoir dispenser inlet 123*a*. Control switch 102*b* further includes water outlet 122*c* liar transferring water to the reservoir dispenser 120*b* via reservoir dispenser inlet 123*b*. Ultimately, the resulting solution or mixture in the reservoir dispensers can be transferred to nozzle assembly 101 for cleaning purposes via reservoir dispenser outlet 125*a* and/or 125*d*. Finally, control switch 102*b* also includes water outlet 122*d*, which can transfer water to the nozzle assembly directly.

Figure 21:
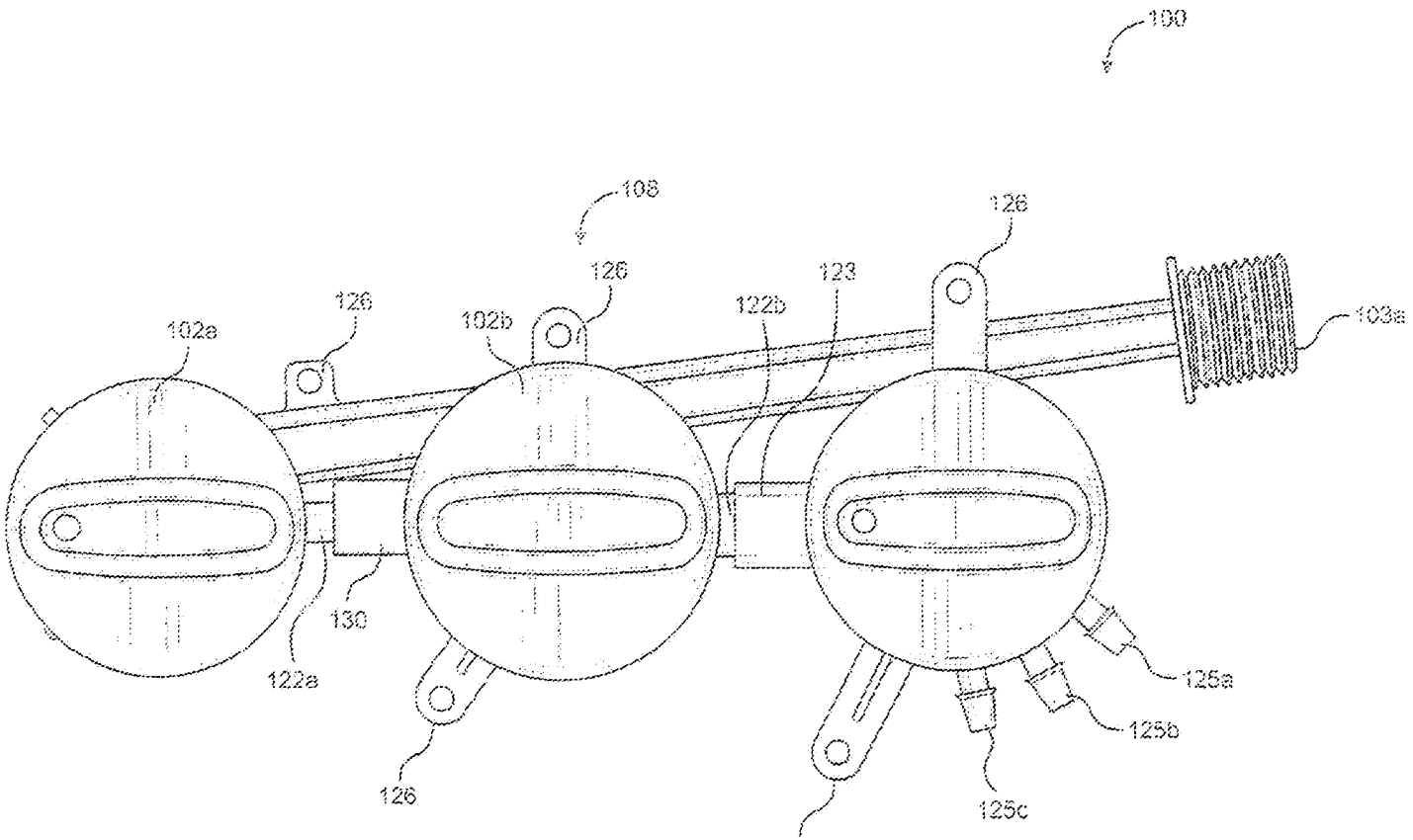
FIG. 21 illustrates a cut-away view of an embodiment of a bidet washing apparatus with a reservoir dispenser with a removable lid.

FIG. 21 illustrates a cut-away view of an embodiment of a bidet washing apparatus 100 with a reservoir dispenser 120 with a removable lid 121. In this figure, the apparatus includes water inlet 103*a* connected to control unit 108 with control switch 102*a*. Control switch 102*a* can act as an on/off switch for the incoming and out-going water. In the on position, water can be transferred from control switch 102*a* to control switch 102*b* via water outlet 122*a* and water inlet 130. Control switch 102*b* includes water outlet 122*b* for transferring water to the reservoir dispenser 120 via reservoir dispenser inlet 123. Ultimately, the resulting solution or mixture in the reservoir dispenser can be transferred to nozzle assembly 101 for cleaning purposes via reservoir dispenser outlet 125*a*, 125*b* and/or 125*c*.

Figure 22:
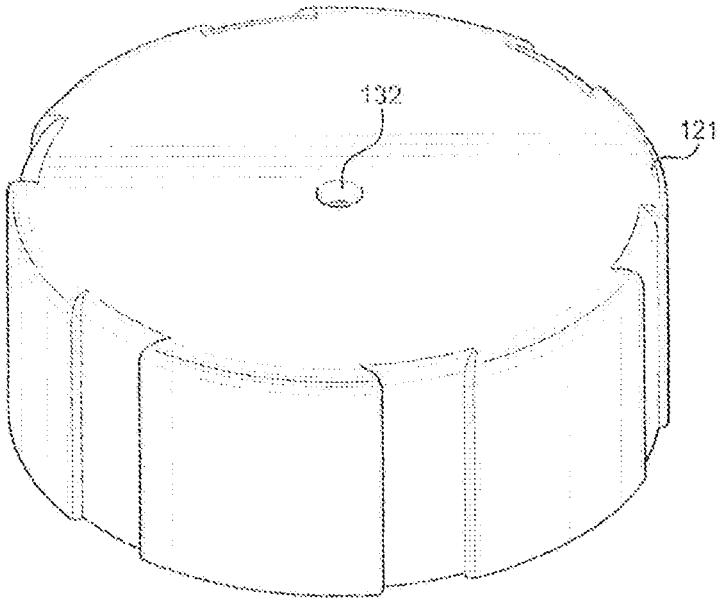
FIG. 22 illustrates an embodiment of a reservoir dispenser lid with a built-in check valve and air vent for securing the reservoir dispenser of a bidet washing apparatus.

FIG. 22 illustrates an embodiment of a reservoir dispenser lid with a built-in check valve system 131 and air vent 132 for securing the reservoir dispenser of a bidet washing apparatus.

A check valve (clack valve, non-return valve, reflux valve, retention valve or a one-way valve) is a valve that normally allows fluid to flow through it in only one direction. Check valves are two-port valves, meaning they have two openings in the body, one for air or fluid to enter and the other for air or fluid to leave. Check valves work automatically and are not controlled by a person or any external control; accordingly, most check valves do not have any valve handle or stem. The bodies (external shells) of most check valves are typically made of plastic or metal but can be made of any suitable material.

A reservoir dispenser lid with a built-in check valve allows the reservoir dispenser system described herein to vent when the bidet washing apparatus is not in use. A check valve allows flow of air or liquid in one direction but not in the other directions. In this case, the lid allows air into the lid (venting the disinfectant/soap reservoir) when the bidet is not in use. When the bidet is in use, the reservoir will be pressurized with water, but no liquid can flow out of the lid. This allows the water filled in the disinfectant/soap reservoir to be flushed out at the end of each use. It is necessary to flush the water in the reservoir because the chemical ingredients of the disinfectant/soap can grow mold and/or dissolve if water present in the reservoir for a prolonged period of time.

An important concept in check valves is the cracking pressure (unseating head pressure or opening pressure), which is the minimum differential upstream pressure inlet and at which the valve will operate. Typically, the check valve is designed for and can be specified for a specific cracking pressure. Reseal pressure (sealing pressure, seating pressure, seating head pressure or closing pressure) refers to the pressure differential between the inlet and outlet of the valve during the closing process of the check valve, at which there is no visible leak rate. Back pressure refers to a pressure higher at the outlet of a fitting than that at the inlet or a point upstream.

A ball check valve the open position allows forward flow and its the closed position, allows the device to block reverse flow. A ball check valve is a check valve in which the closing member, the movable part to block the flow, is a ball. In some ball check valves, the ball can be spring-loaded to help keep it shut. For those designs without a spring, reverse flow is required to move the ball toward the seat and create a seal. The interior surface of the main seats of ball check valves are more or less conically tapered to guide the ball into the seat and form a positive seal when stopping reverse flow.

By contrast, a diaphragm check valve uses a flexing rubber diaphragm positioned to create a normally closed valve. Pressure on the upstream side must be greater than the pressure on the downstream side by a certain amount known as the pressure differential, for the check valve to open allowing flow. Once positive pressure stops, the diaphragm automatically flexes back to its original closed position.

Figure 23:
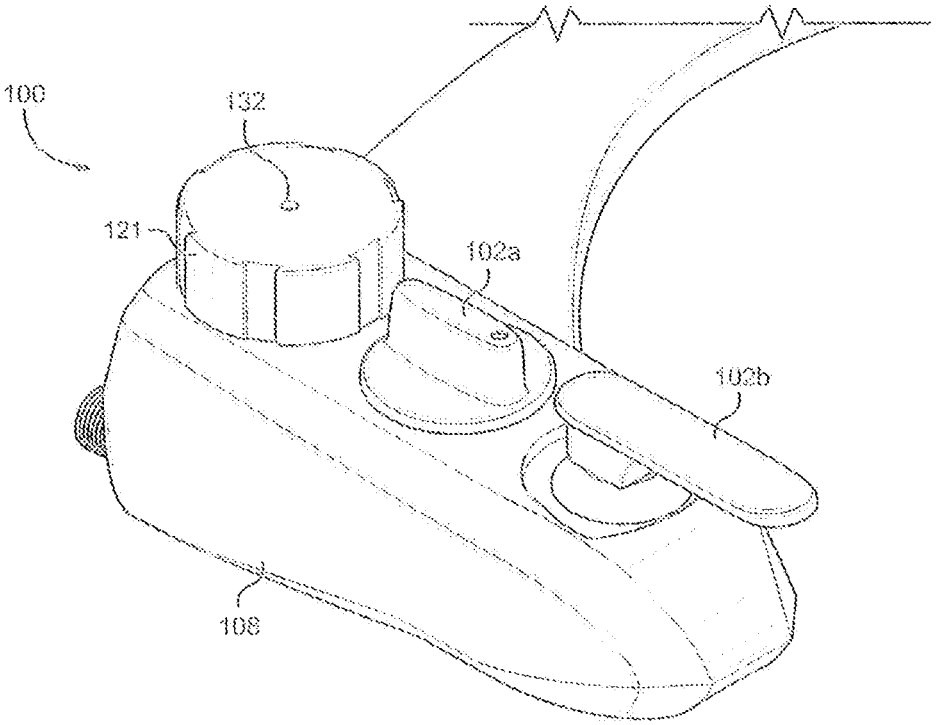
FIG. 23 illustrates an embodiment of a bidet washing apparatus having a reservoir dispenser lid with a built-in check valve and air vent for securing to the reservoir dispenser, the control unit and control switches of a bidet washing apparatus.

FIG. 23 illustrates an embodiment of reservoir dispenser lid with a built-it check valve system 131 and air vent 132 for securing to the reservoir dispenser 120, the control unit 108, control switches 102*a* and 102*b* of a bidet washing apparatus 100. The soap container (not shown) in the reservoir dispenser can be secured within the control panel using screws. As shown, the lid with the built-in check valve system 131 can be exposed for easy removal.

Figure 24:
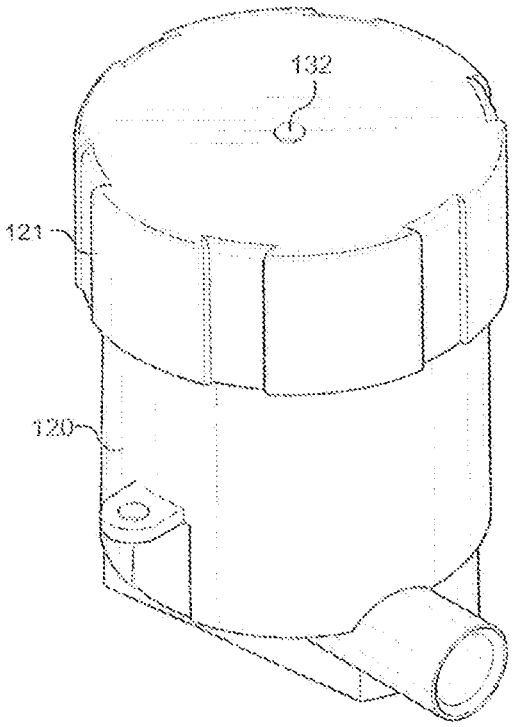
FIG. 24 illustrates an embodiment of a reservoir dispenser lid with a built-in check valve and air vent secured to the reservoir dispenser by being screwed onto or attached to the dispenser.

FIG. 24 illustrates an embodiment of a reservoir dispenser lid 121 with a built-in check valve system 131 and air vent 132 secured to the reservoir dispenser 120 by being screwed onto or attached to the dispenser, i.e., the lid and dispenser can be threaded together, and the lid and dispenser can be snapped together.

Figure 25A:
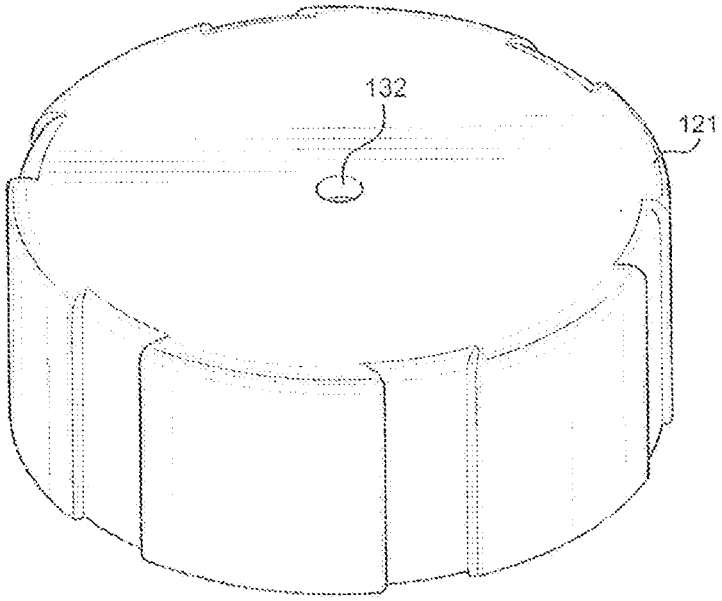
FIG. 25A illustrates an embodiment of the exterior view of the reservoir dispenser lid with a built-in check valve and air vent.
Figure 25B:
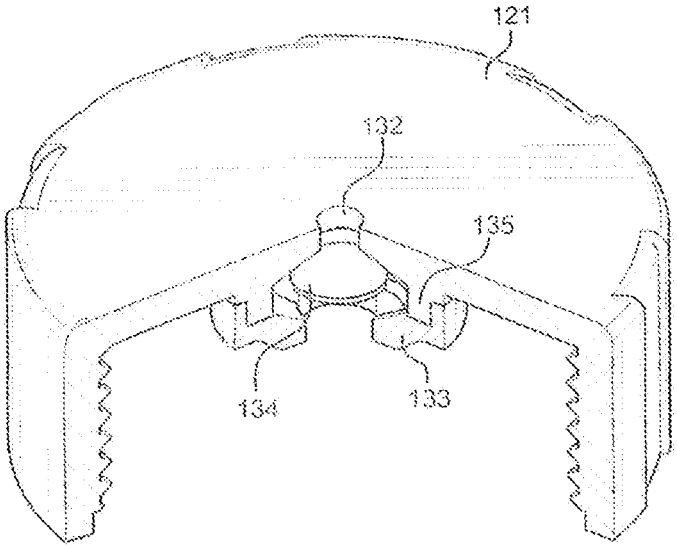
FIG. 25B illustrates an embodiment of a cut-away view of the lid and air vent.

FIG. 25A illustrates an embodiment of the exterior view of the reservoir dispenser lid 121 with a built-in check valve system 131 and air vent 132; and FIG. 25B illustrates an embodiment of a cut-away view of the reservoir dispenser lid 121 and air vent 132. As shown, the inside top of the reservoir dispenser lid 121 can include a check valve 133 and a moveable rubber disk 134, which can be secured to the reservoir dispenser lid 121 via a complementary lip 135.

Figure 26:
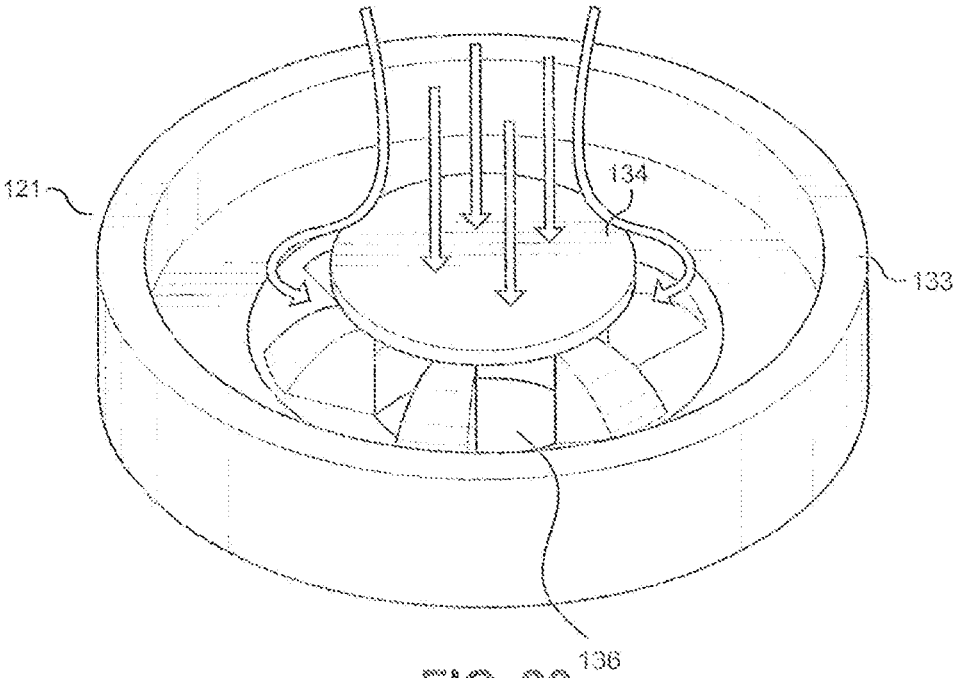
FIG. 26 illustrates an embodiment of the built-in check valve having a moveable rubber disk.

FIG. 26 illustrates an embodiment of the reservoir dispenser lid 121 with a built-in check valve 133 having moveable rubber disk 134. As show this figure, air can flow through the valve via air vent openings 136.

Figure 27:
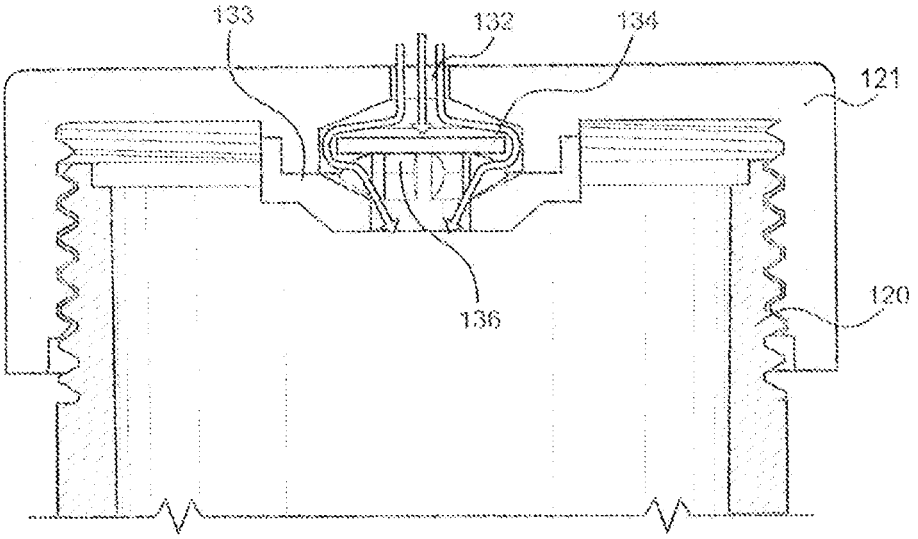
FIG. 27 illustrates an embodiment of a cut-away cross-sectional view of a reservoir dispenser lid with a built-in check valve and air vent with the valve in the opened position.

FIG. 27 illustrates an embodiment of a cut-away cross-sectional view of a reservoir dispenser lid with a built-in check valve system 131 and air vent 132. As shown, air can flow into the lid and the reservoir dispenser 120 through air vent 132 and air vent openings 136. That is, the movable rubber disk 134 of the check valve 133 is in the open position, which allows air to enter the reservoir dispenser through the air vent of the lid.

Figure 28:
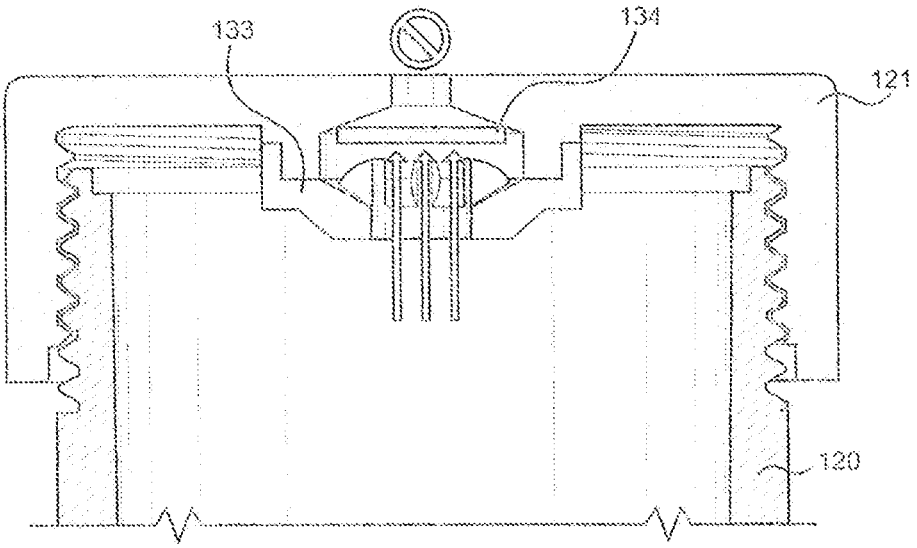
FIG. 28 illustrates an embodiment of a cut-away cross-sectional view of a reservoir dispenser lid with a built-in check valve and air vent with the valve in the closed position.

FIG. 28 illustrates an embodiment of a cut-away cross-sectional view of a reservoir dispenser lid with a built-in check valve system 131 and air vent 132. As shown, air cannot flow into the lid and, into the reservoir dispenser 120 through air vent 132 because it is blocked by the movable rubber disk 134. That is, the movable rubber disk 134 of the check valve 133 is in the closed position due to the high internal pressure of the water pushing up against the rubber disk, which prevents air from entering the reservoir dispenser through the air vent of, the lid and prevents, any liquid from escaping.

In other embodiments, the disclosure provides a reservoir dispenser for a bidet washing apparatus having a plurality of chambers, wherein a first chamber holds liquid wash solution, and a second chamber holds water for flow through the apparatus. In these embodiments, the liquid wash solution from the first chamber can be added to the water present in the second chamber and mixed therein, in a controlled, measured manner without backflow of water into the first chamber.

It is understood by those of skill in the art that the phrase "liquid wash solution" is meant in a non-limiting sense and can include any combination of soap or detergent in a solution of water along with other additives. Additives in this type of solution can include but are not limited to disinfectants, antibacterial, anti-inflammatory, moisturizing, antiseptic, anti-fungal, germicidal, soothing, detoxifying, cooling, antipruritic, hydrating, antiviral, cleansing, cleaning, and deodorizing additives, or a combination thereof.

Figure 29:
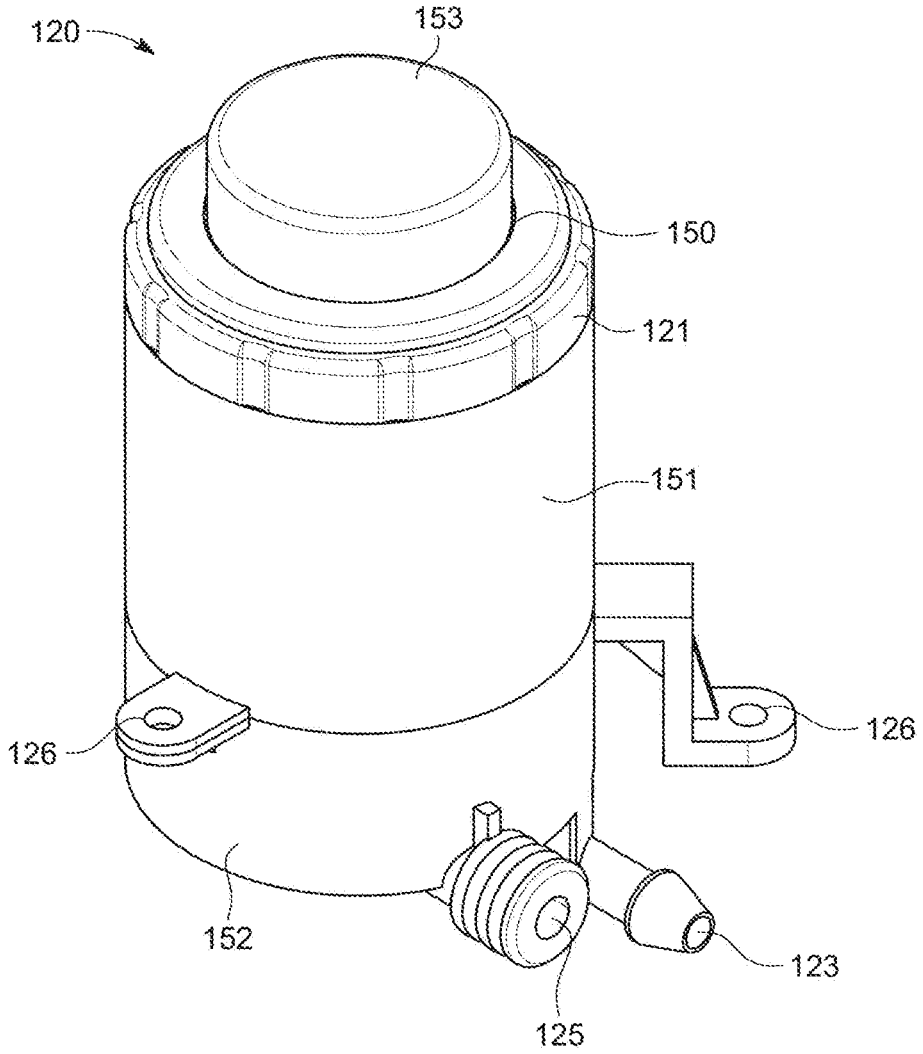
FIG. 29 illustrates an embodiment of a reservoir dispenser which uses a check valve between the first chamber and second chamber.

FIG. 29 illustrates an embodiment of such a reservoir dispenser 120, which uses a check valve (not shown) between the first chamber 151 and the second chamber 152 for control of liquid soap or water without backflow. In some embodiments, the reservoir dispenser 120 can include a lid 121, which can be attached to the first chamber 151. In embodiments, the lid can be permanently or reversibly attachable to the first chamber. Included within the lid 121 is an opening 150, in which a means for activation such as an activator 153 can fill and protrude there through.

As used herein, an "activator" includes but is not limited to a push-button, twist-button, pull up and push down button, a slide button, a plunger button, a lever, a knob or other similar devices.

In some embodiments, the opening can be centrally located within the lid. In embodiments, another means for activation includes but is not limited to a twist mechanism, a slide mechanism, or a pull up and push down mechanism.

In embodiments, the activator 153 can be engaged by manually pushing it downwards to allow for the introduction of the liquid wash solution present in the first chamber 151 to pass into the second chamber 152 through the check valve. Also shown is a securing mechanism or tab 126 for attaching the reservoir dispenser to a bidet washing apparatus (not shown): and the water inlet 123 and the water outlet 125 on the second chamber 152, which allows water to flow into and out of the second chamber, respectively.

Figure 30:
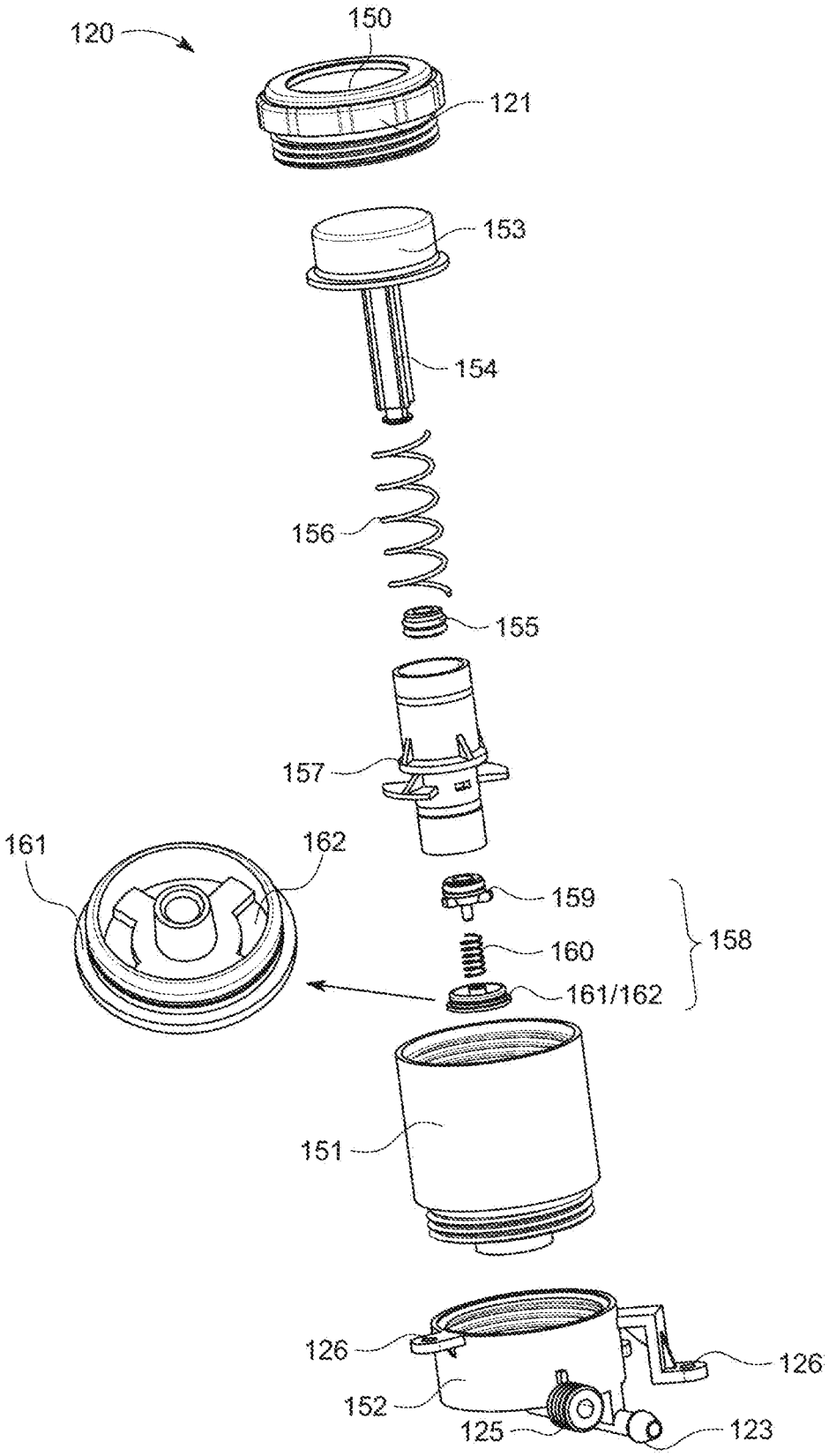
FIG. 30 illustrates an embodiment of an exploded view of a reservoir dispenser which uses a check valve between the first chamber and second chamber.

FIG. 30 illustrates an embodiment of an exploded view of a reservoir dispenser 120 as per FIG. 29. As shown, the reservoir dispenser 120 includes the lid 121 and the opening 150 therein; the activator 153, which is connected to a stem 154, and a distal stem endpiece 155. Also shown is a spring 156, which surrounds the stem 154; and a hollow barrel 157, which surrounds the spring 156 and stem 154. In embodiments, the barrel 157 can be used to guide the stem 154 downwards and upwards when the activator 153 is engaged and disengaged, respectively, i.e., when the activator is manually pressed downwards and released upwards. The reservoir dispenser 120 also includes the first chamber 151, the second chamber 152, the water inlet 123, the water outlet 125, and securing mechanism or tab 126 as described above. Several of the components for a check valve 158 are also shown including a check valve disc 159, a check valve spring 160, and a check valve guide 161 having one or more openings 162 there through. As explained below, the additional components of the check valve 158 are made up of the stem 154 and sidewalls 163 of the barrel 157.

Figure 31A:
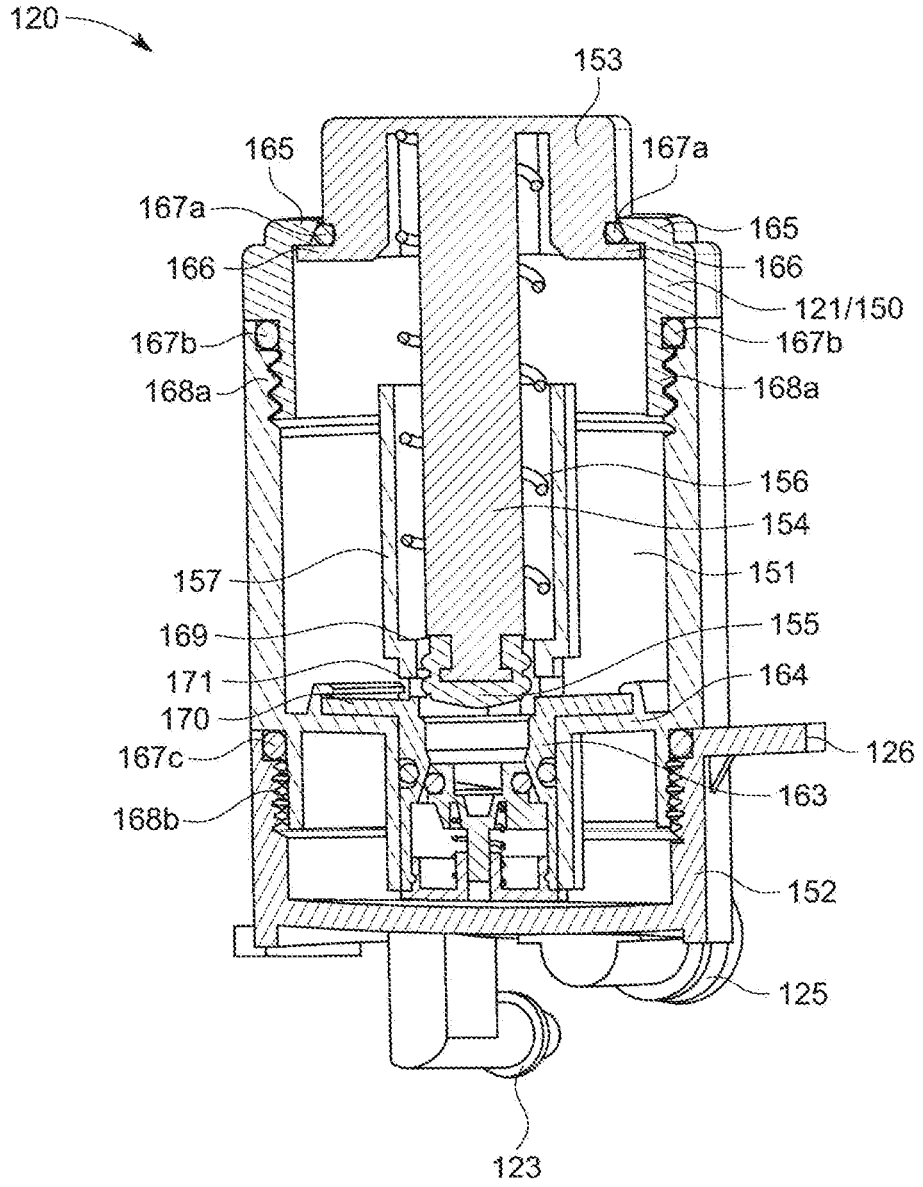
FIG. 31A illustrates an embodiment of a side cut-away view of a reservoir dispenser which uses a check valve between the first chamber and second chamber.

FIG. 31A illustrates an embodiment of a side cut-away view of the reservoir dispenser 120 as per FIGS. 29 and 30. The reservoir dispenser 120 includes the first chamber 151 and second chamber 152, wherein the first chamber extends downwards into the second chamber. The first chamber 151 also includes a base platform 164, which secures the barrel 157, separates the first chamber 151 and the second chamber 152, and which extends down into the second chamber along with the sidewalls 163 of the barrel 157. Also shown are the lid 121 and the opening 150, the activator 153, which fills and protrudes there through, and the water inlet 123 and the water outlet 125, which are connected to the second chamber 152.

The lid 121 can include a lid lip 165, which surrounds the opening 150, and is designed to engage with and secure the activator 153 through a complimentary activator lip 166, and an O-ring 167*a* there between, which prevents leakage of the liquid wash solution present in the first chamber 151.

The first chamber 151 can be reversibly connected to the lid 121 through a screw-on, threaded type mechanism 168*a*, or can be snapped on, or can be secured permanently or reversibly or by any other means known in the art. In addition, an O-ring 167*b* can be used between the first chamber 151 and the lid 121, which prevents leakage of the liquid wash solution present in the first chamber 151.

The second chamber 152 can also be reversibly connected to the first chamber 151 through a screw-on, threaded type mechanism 168*b*, or can be snapped on, or can be secured permanently or reversibly or by any other means known in the art. In addition, an O-ring 167*c* can be used between the second chamber 152 and the first chamber 151, which prevents leakage of the water present in the second chamber 152.

The activator 153 can include the stem 154, which runs proximally from the activator down through the first chamber 151, and distally towards the first chamber base platform 164. The distal end of the stem 154 includes the stem endpiece 155, which covers the bottom and sides of the stem. The stem end piece can be made of any pliable or flexible materials including but not limited to polymers, plastics, rubber, elastomers or rubber-like materials, and the like.

The barrel 157 can include a ridge 169, a base platform 170, and at least one or more openings 171 located around the base platform, which allows the liquid wash solution present in the first chamber 151 to enter the barrel. In embodiments, the sidewalls 163 of the barrel can also extend down into the second chamber 152.

Also included is a spring 156, which can be situated between the activator 153, around the stem 154, and to the ridge 169 to provide support and/or resistance for the activator 153.

The first chamber base platform 164 supports and secures the barrel 157 and the barrel base platform 170. As described above, the barrel 157 can include one or more openings 171, which allows the liquid wash solution present in the first chamber 151, to enter the second chamber 152 when the check valve 158 is forced opened by downward pressure on the activator 153.

Figure 31B:
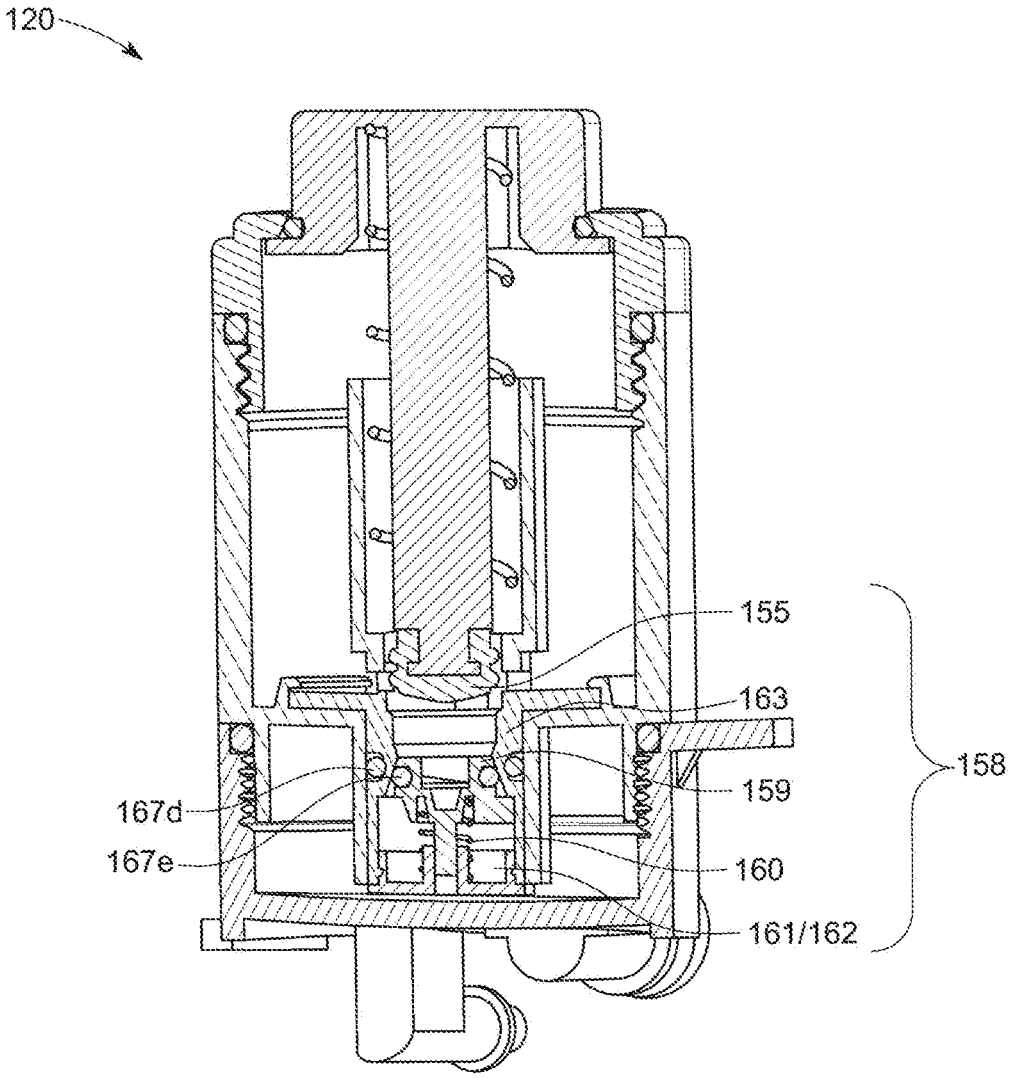
FIG. 31B illustrates an embodiment of a side cut-away view of a reservoir dispenser which uses a check valve between the first chamber and second chamber.

As shown in FIG. 31B, the following components make up the check valve 158: the stem endpiece 155, the check valve disc 159, the check valve spring 160, the sidewalls 163 of the barrel, and the check valve guide 161 having one or more check valve guide openings 162 there through. Also shown are two O-rings: O-ring 167*d* seals the sidewalls 163 of the barrel against the first chamber base platform 164; and O-ring 167*e*, seals the check valve disc 159 against the sidewalls 163 of the barrel.

A check valve allows the flow of liquid in one direction. Typically, a check valve has two openings: a check valve input side, and a check valve output side. Since a check valve only allow fluid to flow in one direction, they are commonly referred to as 'one-way valves' or 'non return valves.' The main purpose of a check valve is to prevent backflow into the system.

A check valve device relies on a pressure differential to work. They require a higher pressure (cracking pressure) on the input side than the output side to open the valve. When the pressure is higher on the outlet side, the valve will close. Depending on the valve type, the closing mechanism can be different. In short, the back pressure can push a gate, ball, diaphragm, or disc against an orifice and seal it. Depending on the design, the closing process can be assisted by a spring or gravity. Common types of check valves include but are not limited to spring loaded check valves, diaphragm check valves, umbrella check valves, duckbill check valves, and others.

Figures 32A, 32B, 32C:
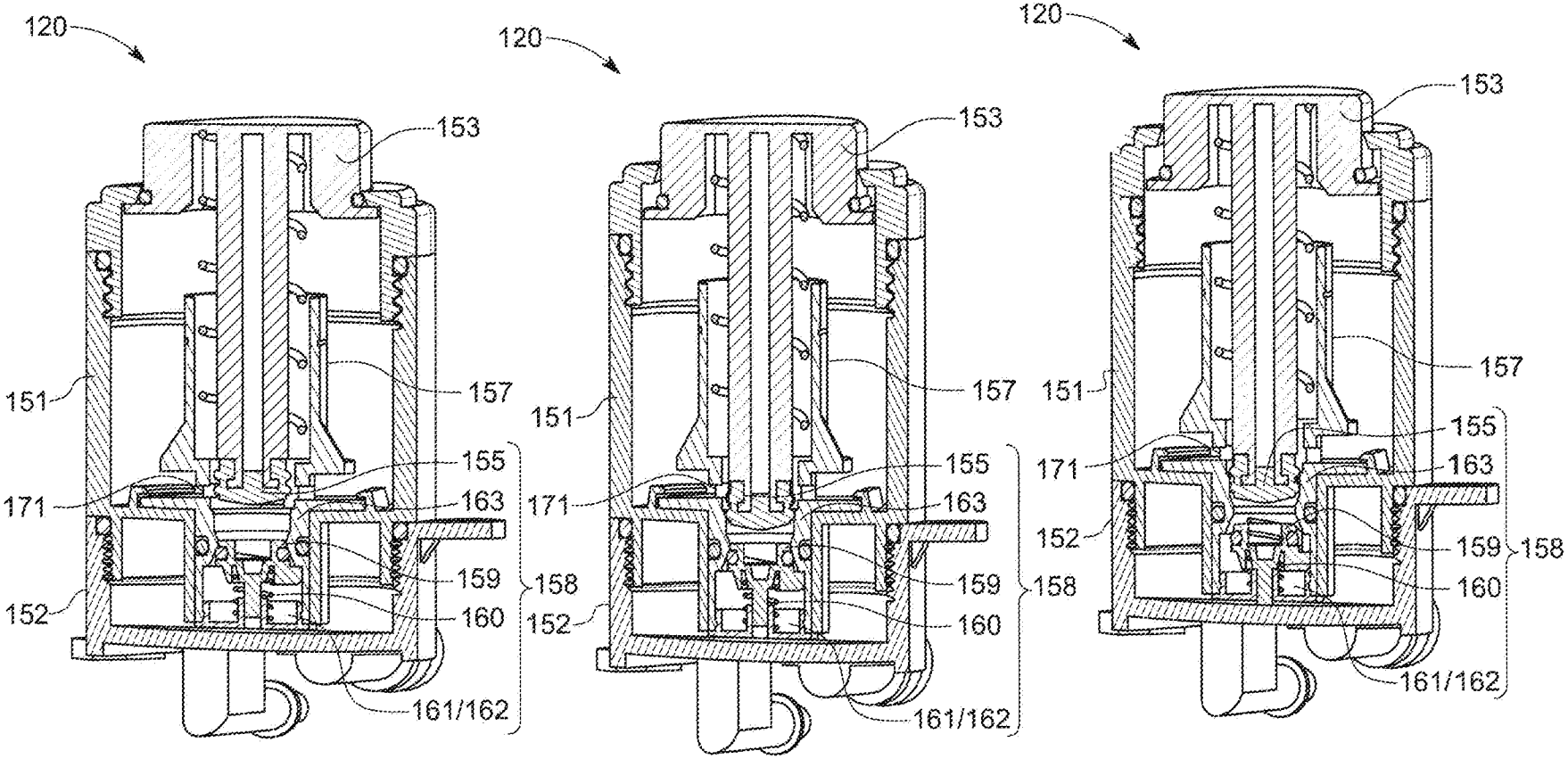
FIG. 32A illustrates an embodiment of a side cut-away view of a reservoir dispenser which uses a check valve between the first chamber and second chamber.
FIG. 32B illustrates an embodiment of a side cut-away view of a reservoir dispenser which uses a check valve between the first chamber and second chamber.
FIG. 32C illustrates an embodiment of a side cut-away view of a reservoir dispenser which uses a check valve between the first chamber and second chamber.

FIGS. 32A, 32B, and 32C illustrate an embodiment of a side cut-away view of a reservoir dispenser 120 having a check valve in action.

As shown in FIG. 32A, initially the liquid wash solution present in the first chamber 151 remains separated from the water in the second chamber 152 by action of the check valve 158. The check valve 158 includes the check valve disc 159, which remains pressed against the sidewalls 163 of the barrel 157 by action of the check valve spring 160 and check valve guide 161. The liquid wash solution present in the first chamber 151 can enter the barrel 157 through the openings 171 present in the barrel 157 but is stopped from entering the second chamber 152 by the check valve disc 159 pressing against the sidewalls 163 of the barrel.

As shown in FIG. 32B, downward movement on the activator 153 causes an aliquot of the liquid wash solution in the first chamber 151 to be trapped between the stem endpiece 155, the sidewalls 163 of the barrel 157, and the check valve disc 159.

As shown in FIG. 32C, further downward movement on the activator 153 results in sufficient force or pressure to overcome the cracking pressure of the check valve 158 and forces the check valve disc 159 and check valve spring 160 downwards, which allows the trapped aliquot of the liquid wash solution to flow through the check valve guide 161 and its' openings 162 and into the second chamber 152, where upon the aliquot of liquid wash solution is mixed with the water present in this chamber.

When the input pressure is no longer high enough on the check valve due to upwards motion or release of the activator 153, then the backpressure and/or check valve spring 160 pushes the check valve disc 159 upwards and against the sidewalls 163 of the barrel and seals and separates the contents of the first chamber 151 from the contents of the second chamber 152. The check valve spring 160, along with the short travel distance for the check valve disc 159, allows for quick reaction times for opening and closing.

In other embodiments, the disclosure provides another reservoir dispenser for a bidet washing apparatus having a plurality of chambers, wherein a first chamber holds liquid wash solution, and a second chamber holds water for flow through the apparatus. In these embodiments, the liquid wash solution from the first chamber can be added into the water present in the second chamber and mixed therein, in a controlled, measured manner without backflow of water into the first chamber.

Figure 33:
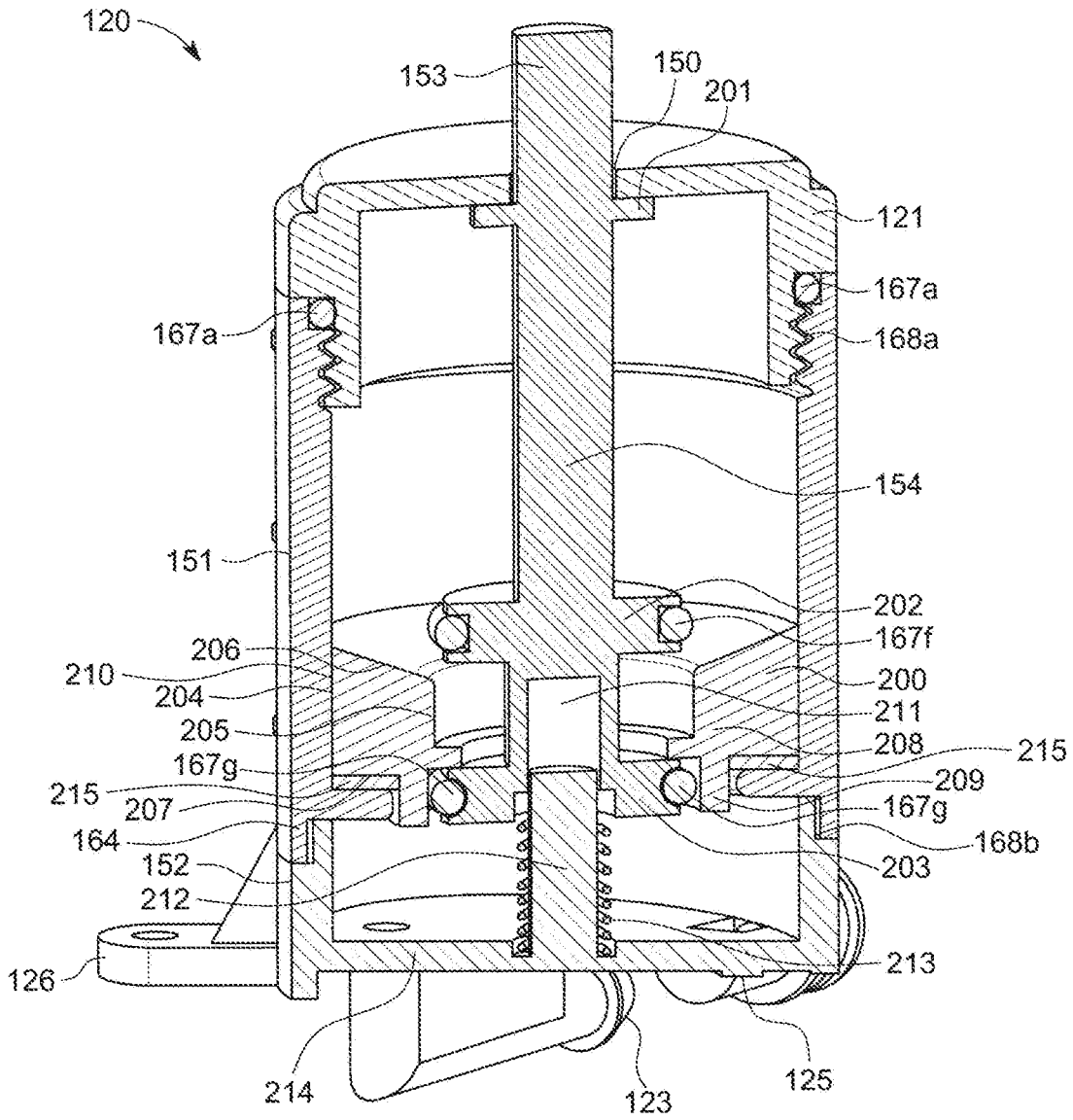
FIG. 33 illustrates an embodiment of a side cut-away view of a reservoir dispenser which uses an annular ring between the first chamber and the second chamber.

FIG. 33 illustrates an embodiment of a side cut-away view of a reservoir dispenser 120, which uses an activator 153 and an annular ring 200 between the first chamber 151 and the second chamber 152 for control of the liquid wash solution. In embodiments, the activator 153 includes a stem 154 having a top bar or ring 201, a medial bar or ring 202, and a distal bar or ring 203. The top bar or ring 201 keeps the activator 153 within the opening 150 of the lid 121, whereas the medial bar or ring 202 and distal bar or ring 203 are used to carry the liquid wash solution present in the first chamber 151 to the second chamber 152 by passing through the annular ring 200. As shown, the first chamber 151 includes a first chamber base platform 164, which provides support for the annular ring 200 and separates the first chamber 151 and the second chamber 152. Also shown is a gasket 215, which is located between the first chamber base platform 164 and the annular ring 200.

The reservoir dispenser 120 includes a lid 121, which can be attached to the first chamber 151. Included within the lid 121 is an opening 150, in which an activator 153 can fill and protrude there through. In embodiments, the opening 150 can be centrally located. As shown, the activator 153 can be manually pushed downwards to activate the introduction of the liquid wash solution present in the first chamber 151 to water in the second chamber 152 through the annular ring 200. Also shown is a securing mechanism or tab 126, for attaching the reservoir dispenser to a bidet washing apparatus (not shown); and the water inlet 123 and the water outlet 125, which allows water to flow into and out of the second chamber 152, respectively.

The first chamber 151 can be reversibly connected to the lid 121 through a screw-on, threaded type mechanism 168*a*, or can be snapped on, or can be secured permanently or reversibly or by any other means known in the art. In addition, an O-ring 167*a* can be used between the first chamber 151 and the lid 121, which prevents leakage of the liquid wash solution present in the first chamber 151.

The second chamber 152 can also be reversibly connectable to the first chamber 151 through a screw-on, threaded type mechanism 168*b*, or can be snapped on, or can be secured permanently or reversibly or by any other means known in the art. In addition, in some embodiments an O-ring can be used between the second chamber 152 and the first chamber 151, which prevents leakage of the water present in the second chamber 152.

The annular ring 200 includes outer side walls 204, inner side walls 205, a top side 206, a bottom side 207, an inner side lip 208, and a bottom side ridge 209. The annular ring 200 can be supported or secured horizontally and vertically by the first chamber base platform 162 and the inner walls 210 of the first chamber 151, respectively. The inner side lip 208 of the annular ring 200 separates the first chamber 151 from the second chamber 152, and the bottom side ridge 209 of the annular ring 200 runs along an edge of the first chamber base platform 164 and protrudes down into the second chamber 152. In embodiments, the annular ring 200 and its components can be made of any pliable or flexible materials including but not limited to polymers, plastics, rubber, elastomers or rubber-like materials, and the like.

The activator 153 includes the stem 154, which runs proximally from the activator down through the first chamber 151, and distally through the annular ring 200 and into the second chamber 152. The proximal region of the stem 154 includes the top bar or ring 201, the medial region includes the medial bar or ring 202, and the distal region includes the distal bar or ring 203. The top bar or ring 201 and the medial ring 202 are present only in the first chamber 151, whereas the distal bar or ring 203 is present only in the second chamber 152. The medial bar or ring 202 and the distal bar or ring 203 can each include an O-ring 167*f* and 167*g*, respectively, which wraps around the circumference of their respective ring.

The distal end of the stem 154 can also include an inlet 211, which runs from the end of the distal bar or ring 203 to about an area below the medial bar or ring 202. In embodiments, the second chamber 152 can include a centrally located post 212, in which the post 212 can guide the stem 154 through the inlet 211. Finally, the second chamber 152 can include a spring 213 between the base of the second chamber 214 and the distal end of the stem 154, which provides support or resistance for the activator 153.

Figure 34A:
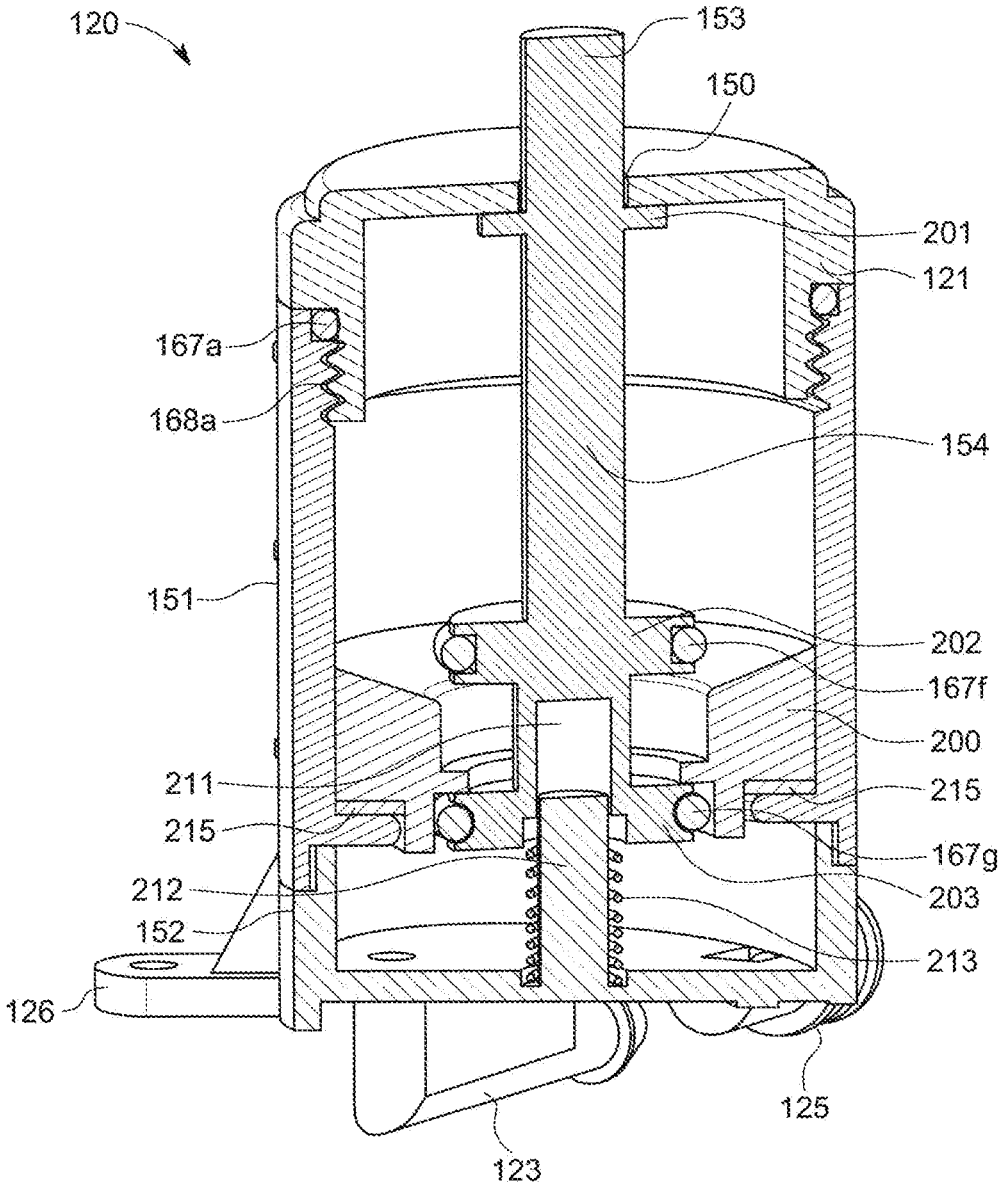
FIG. 34A illustrates an embodiment of a side cut-away view of a reservoir dispenser which uses an annular ring between the first chamber and the second chamber.
Figure 34B:
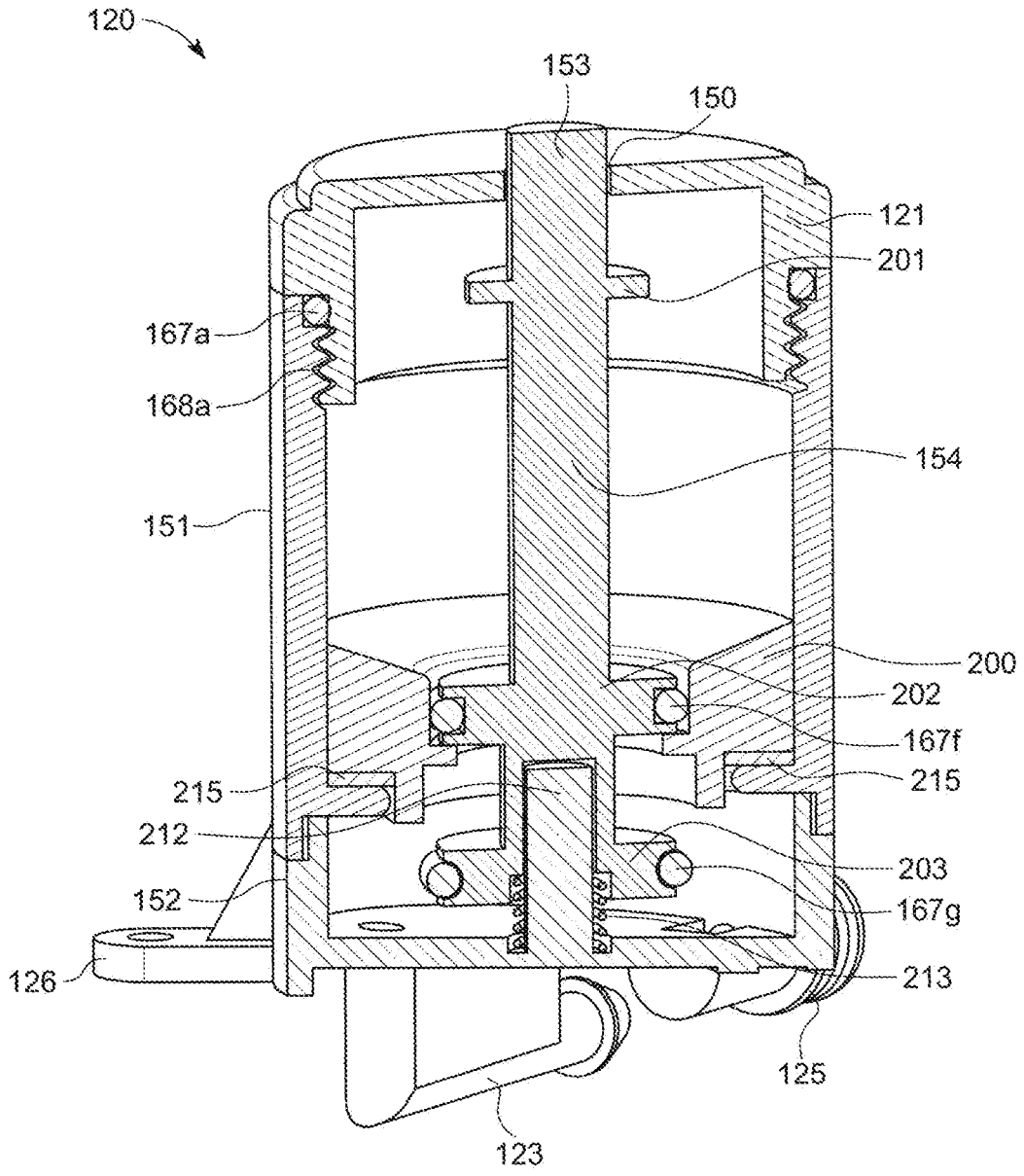
FIG. 34B illustrates an embodiment of a side cut-away view of a reservoir dispenser which uses an annular ring between the first chamber and the second chamber.

FIGS. 34A and 34B illustrate an embodiment of a side cut-away view of a reservoir dispenser 120 having and annular ring 200 between the first chamber 151 and the second chamber 152 and an activator 153 with a stem 154 for carrying an aliquot of liquid wash solution present in the first chamber to the water in the second chamber. In embodiments, the activator 153 can be manually pushed downwards to activate introduction of the liquid wash solution.

As shown in FIG. 34A, initially the liquid wash solution present in the first chamber 151 remains separated from the water in the second chamber 152 by action of the distal bar or ring 203 and corresponding O-ring 167*g* pressing against the inner side lip 208 and the bottom side ridge 209 of the annular ring by action of the spring 213 between the base of the second chamber 214 and the distal end of the stem 154. An aliquot of the liquid wash solution can enter the space between the medial bar or ring 202 and the distal bar or ring 203 of the stem 154 in the first chamber 151 but cannot enter the second chamber 152.

As shown in FIG. 34B, downward force on the activator 153 causes the spring 213 to compress, which allows the second chamber base post 212 to ride on the stem inlet 211, thereby delivering the aliquot of the liquid wash solution from the first chamber 151 to the second chamber 152, where upon the liquid wash solution is mixed with the water present in this chamber. The first chamber 151 and the second chamber 152 remain separated by the force of the medial bar or ring bar or 202 and corresponding O-ring 167*f* pressing against the inner side walls 205 and the inner side lip 208 of the annular ring 200.

When the input pressure is no longer high enough due to upwards motion or release of the activator 153, then the spring 213 in the second chamber 152 can push the stem 154 upwards and the distal bar or ring 203 and corresponding O-ring 167*g* can again press against the inner side lip 208 and the bottom side ridge 209 of the annular ring, thereby separating the first chamber 151 from the second chamber 152.

In other embodiments, the disclosure further provides a bidet washing apparatus with a reservoir dispenser having a plurality of chambers, wherein a first chamber holds liquid wash solution, and a second chamber holds water for flow through the apparatus. In these embodiments, the liquid wash solution from the first chamber can be added into the second chamber and mixed with the water in a controlled manner without backflow of water into the first chamber.

Figure 35:
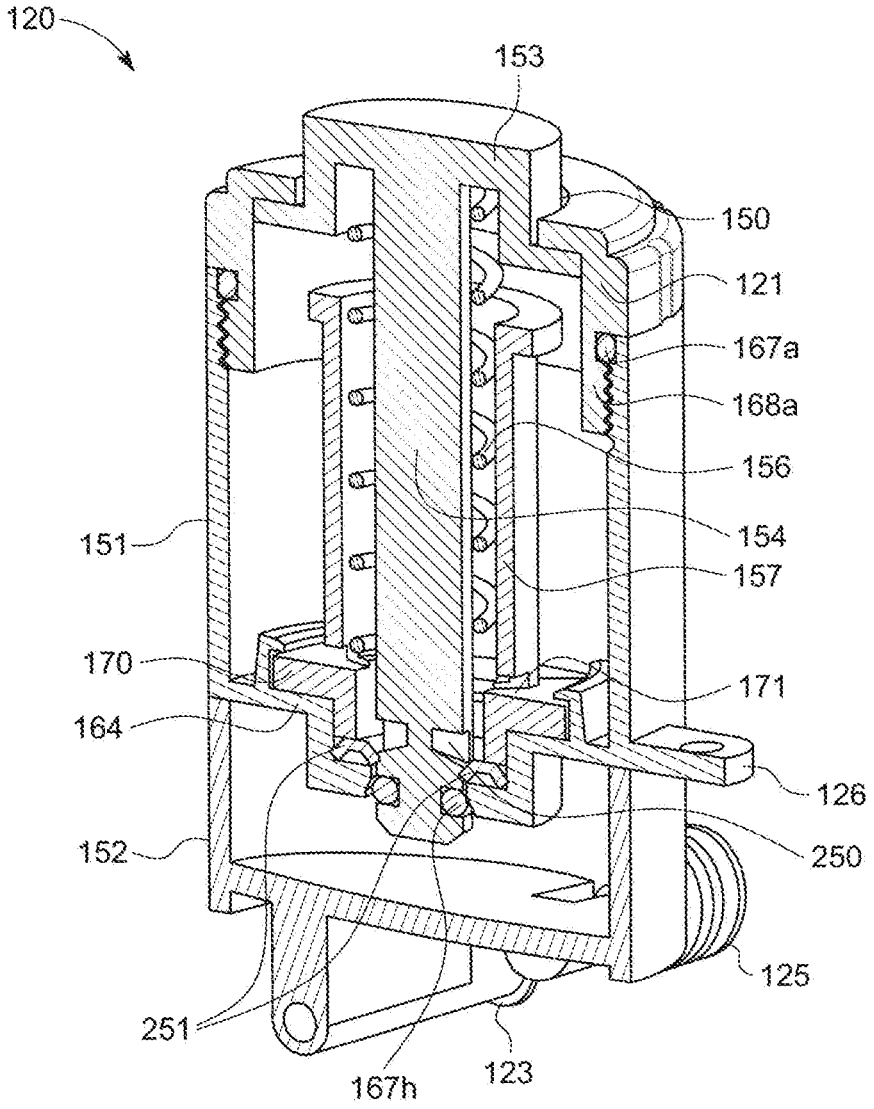
FIG. 35 illustrates an embodiment of a side cut-away view of a reservoir dispenser which uses a stem with one or more grooved openings.

FIG. 35 illustrates an embodiment of a side cut-away view of a reservoir dispenser 120, which uses an activator 153 with a stem 154 having one or more grooved openings 250 and an O-ring 167*h* below the one or more grooved openings in the distal region of the stem, which can hold an aliquot of liquid wash solution and travels between the first chamber 151 and the second chamber 152 to deliver the aliquot.

The first chamber 151 includes a first chamber base platform 164, which secures a hollow barrel 157 and a barrel base platform 170. The first chamber base platform 164 and the barrel base platform 170 each extend down into the second chamber 152. Between the first chamber base platform 164 and the barrel base platform 170 lies a platform ring 251, which surrounds the stem 154.

A spring 156 surrounds the stem 154, and the barrel 157 surrounds the spring 156 and stem 154. In embodiments, the barrel 157 can be used to guide the stem 154 downwards and upwards when the activator 153 is engaged and disengaged, respectively, i.e., when the activator is manually pressed downwards and released upwards. The reservoir dispenser 120 also includes the water inlet 123, the water outlet 125, and securing mechanism or tabs 126.

The reservoir dispenser 120 includes a lid 121, which can be attached to the first chamber 151. Included within the lid 121 is an opening 150, in which an activator 153 can fill and protrude there through. In embodiments, the opening can be centrally located within the lid. In embodiments, the activator 153 can be manually pushed downwards to activate the introduction of the liquid wash solution present in the first chamber 151 to water in the second chamber 152.

The first chamber 151 can be reversibly connected to the lid 121 through a screw-on, threaded type mechanism 168*a*, or can be snapped on, or can be secured permanently or reversibly or by any other means known in the art. In addition, an O-ring 167*a* can be used between the first chamber 151 and the lid 121, which prevents leakage of the liquid wash solution present in the first chamber 151.

The second chamber 152 can also be reversibly connectable to the first chamber 151 through a screw-on, threaded type mechanism 168*b*, or can be snapped on, or can be secured permanently or reversibly or by any other means known in the art. In addition, an O-ring 167*b* can be used between the second chamber 152 and the first chamber 151, which prevents leakage of the water present in the second chamber 152.

The activator 153 includes the stem 154, which runs proximally from the activator down through the first chamber 151, and distally through the barrel base platform 170 and the first chamber base platform 164 and into the second chamber 152. The O-ring 167*h* on the distal end of the stem 154 can be secured against the first chamber base platform 164, which seals the first compartment 151 from the second compartment 152.

Figure 36A:
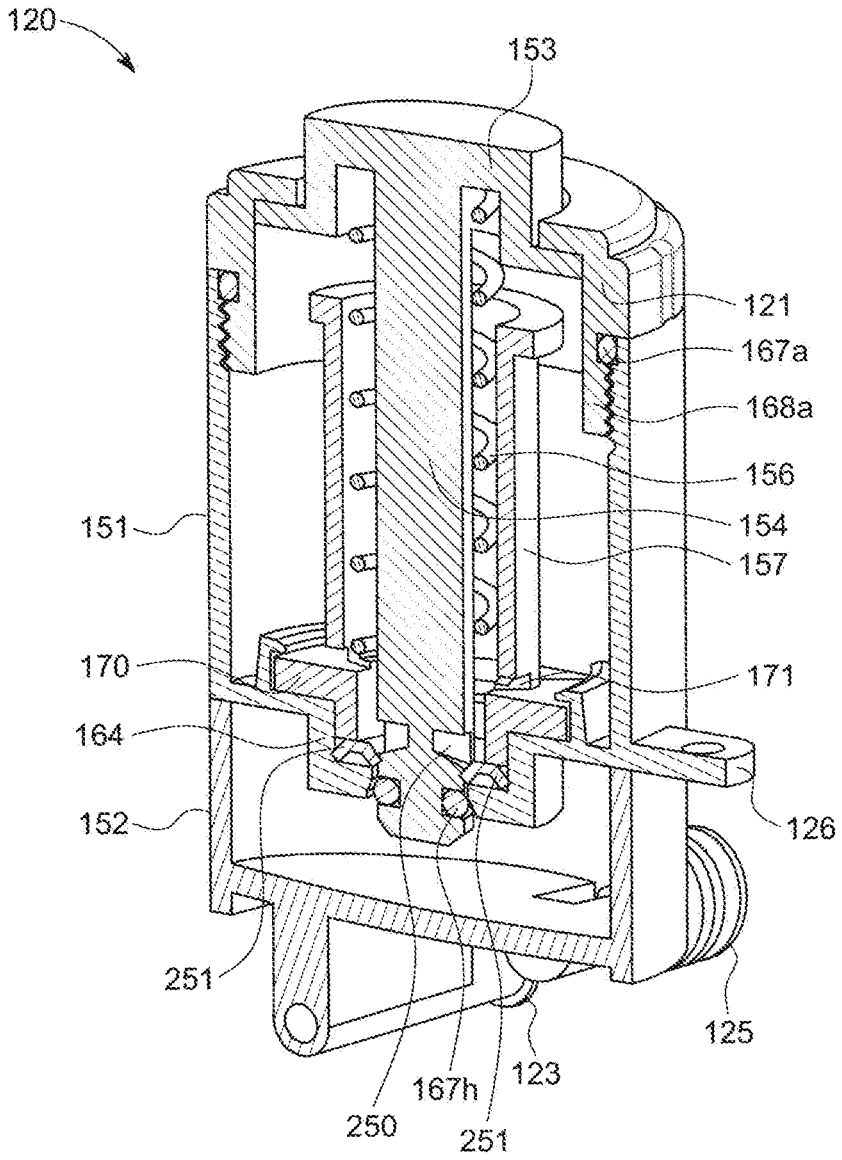
FIG. 36A illustrates an embodiment of a side cut-away view of a reservoir dispenser, which uses a stem with one or more grooved openings.
Figure 36B:
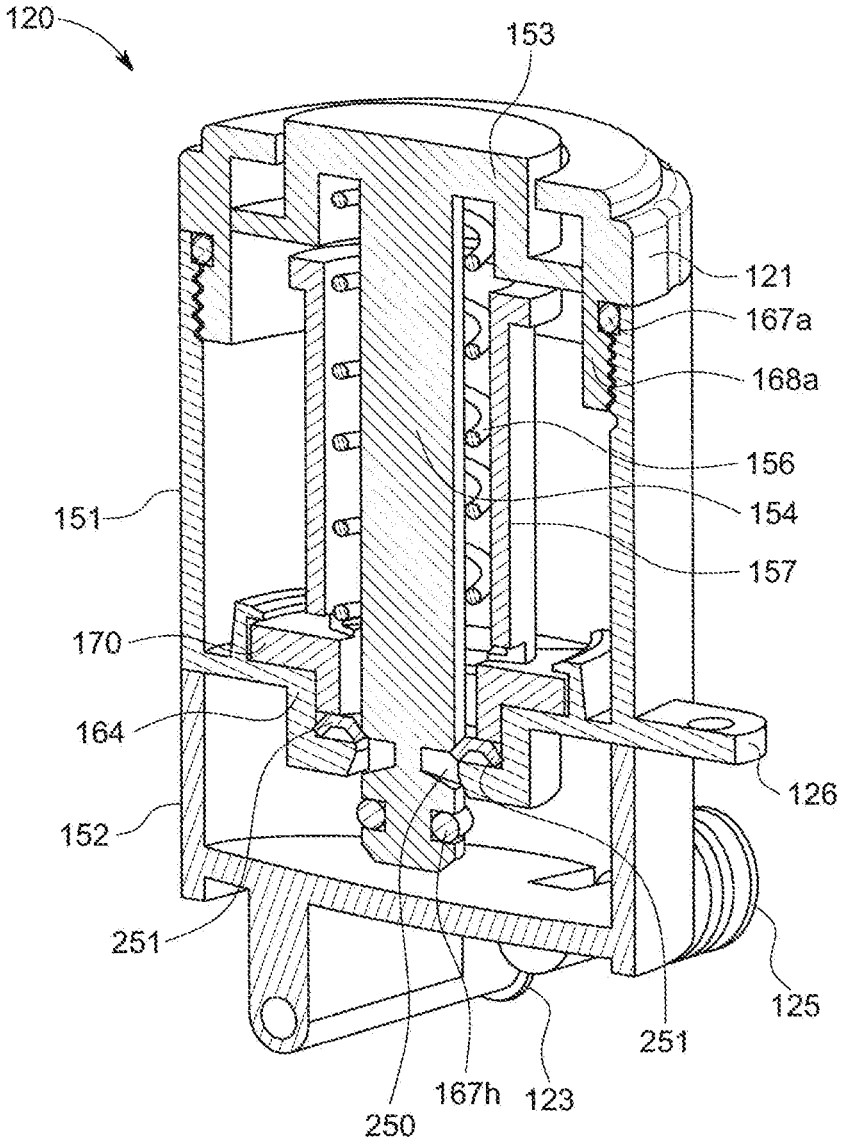
FIG. 36B illustrates illustrate an embodiment of a side cut-away view of a reservoir dispenser, which uses a stem with one or more grooved openings.

FIGS. 36A and 36B illustrate an embodiment of a side cut-away view of a reservoir dispenser 120, which uses an activator 153 with a stem 154 having one or more grooved openings 250 and an O-ring 167*h* below the one or more grooved openings for carrying liquid wash solution present in the first chamber to the water in the second chamber. In embodiments, the activator 153 can be manually pushed downwards to activate introduction of the liquid wash solution.

As shown in FIG. 36A, initially the liquid wash solution present in the first chamber 151 remains separated from the water in the second chamber 152 by action of the O-ring 167*h* beneath the one or more grooves 250 on the stem 154 pressing against the first chamber base platform 164, and the platform ring 251 located between the first chamber base platform 164 and the barrel base platform 170 pressing against the stem. As described above, an aliquot of the liquid wash solution in the first chamber 151 can enter the one or more grooved openings 250 in the stem 154 through the one or more openings 171 in the barrel 157 but cannot enter the second chamber 152.

As shown in FIG. 36B, downward force on the activator 153 causes the spring 156 to compress, which allows the stem 154, associated O-ring 167*h* and an aliquot of the liquid wash solution present in the one or more grooves 250 to enter the second chamber 152, where upon the liquid wash solution is mixed with the water present in this chamber. The first chamber 151 and the second chamber 152 remain separated by the platform ring 251 sealing against the stem 154.

When the input pressure is no longer high enough due to upwards motion or release of the activator 153, then the spring 156 pushes the stem 154 upwards and the corresponding O-ring 167*h* can press against the first chamber base platform 164 and the platform base ring 251 seals against the stem thereby separating the first chamber 151 from the second chamber 152.

In other embodiments, the disclosure further provides a bidet washing apparatus with a reservoir dispenser having a plurality of chambers, wherein a first chamber holds liquid wash solution, and a second chamber holds water for flow through the apparatus. In these embodiments, the liquid wash solution from the first chamber can be added into the second chamber and mixed with the water in a controlled manner without backflow of water into the first chamber.

Figure 37:
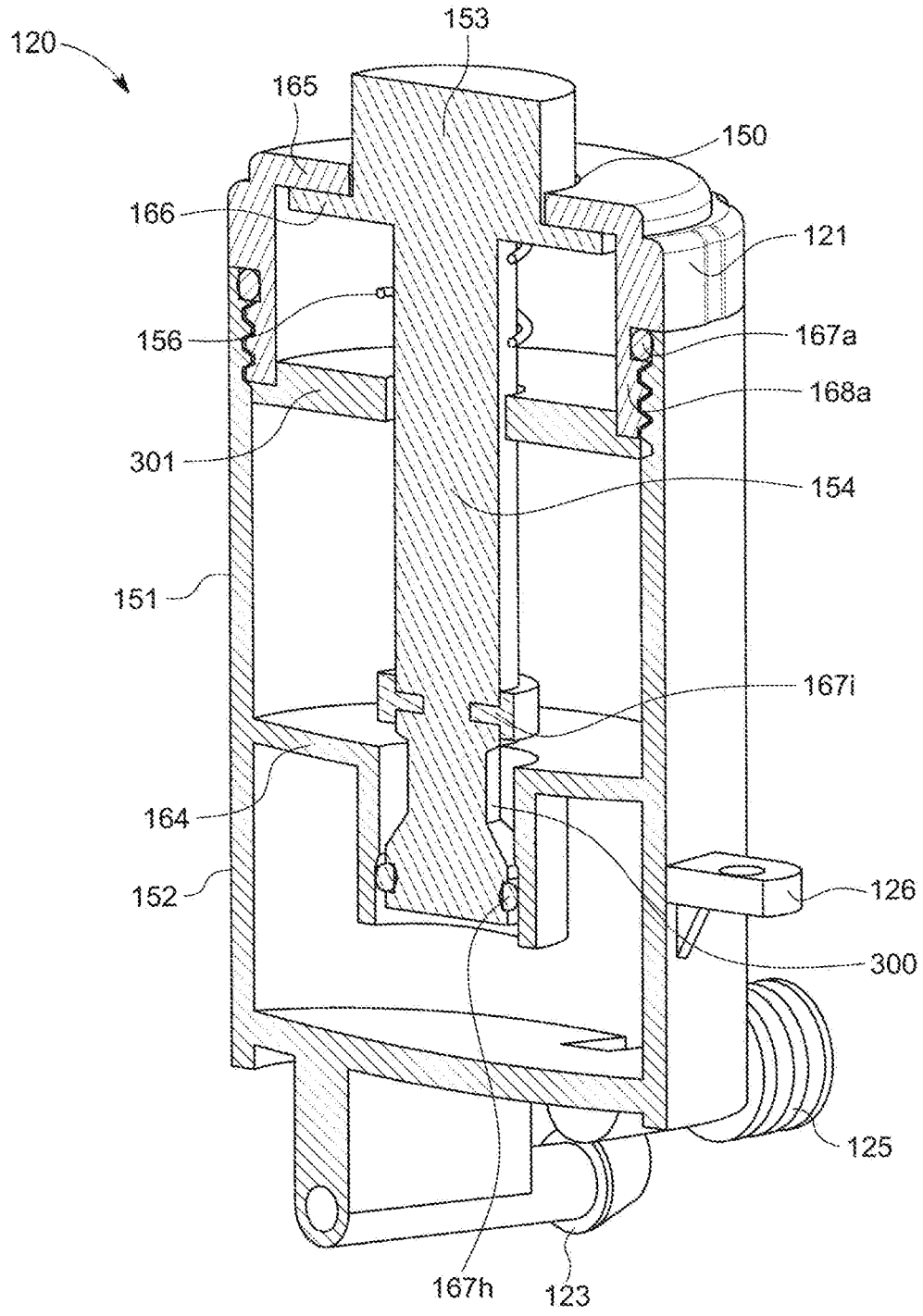
FIG. 37 illustrates an embodiment of a side cut-away view of a reservoir dispenser which uses a stem with a narrowed band.

FIG. 37 illustrates an embodiment of a side cut-away view of a reservoir dispenser 120, which uses an activator 153 with a stem 154 having a narrowed band 300 in a distal region of the stem, and a lower O-ring 167*h* and an upper O-ring 167*i* between the band, which can hold an aliquot of liquid wash solution while in the first chamber 151 and travel between the first and the second chamber 152 to deliver the aliquot.

The first chamber 151 includes a first chamber base platform 164 and a first chamber top platform 301, which secures the stem 154 and can be used to guide the stem 154 downwards and upwards when the activator 153 is engaged and disengaged, respectively, i.e., when the activator is manually pressed downwards and released upwards. The first chamber base platform 164 extends down into the second chamber 152; and the first chamber top platform 301 supports the lid 121. Secured to the first chamber top platform 301 is a spring 156, which wraps around the stem 154 and presses against the activator 153. The reservoir dispenser 120 also includes the water inlet 123, the water outlet 125, and securing mechanism or tabs 126.

The reservoir dispenser 120 includes a lid 121, which sits on top of and is connected and/or secured to the first chamber 151. Included within the lid 121 is a centrally located opening 150, in which an activator 153 can fill and protrude there through. In embodiments, the activator 153 can be manually pushed downwards to activate the introduction of the liquid wash solution present in the first chamber 151 to water in the second chamber 152.

The lid 121 can include a lid lip 165, which surrounds the opening 150, and is designed to engage with and secure the activator 153 through a complimentary activator lip 166, and an O-ring 167*a* there between, which prevents leakage of the liquid wash solution present in the first chamber 151.

The first chamber 151 can be reversibly connected to the lid 121 through a screw-on, threaded type mechanism 168*a*, or can be snapped on, or can be secured permanently or reversibly or by any other means known in the art. In addition, an O-ring 167*b* can be used between the first chamber 151 and the lid 121, which prevents leakage of the liquid wash solution present in the first chamber 151.

The second chamber 152 can also be reversibly connectable to the first chamber 151 through a screw-on, threaded type mechanism 168*b*, or can be snapped on, or can be secured permanently or reversibly or by any other means known in the art. In addition, an O-ring 167*c* can be used between the second chamber 152 and the first chamber 151, which prevents leakage of the water present in the second chamber 152.

The activator 153 includes the stem 154, which runs proximally from the activator down through the first chamber 151, the first chamber base platform 164 and into the second chamber 152. The O-ring 167*h* on the distal end of the stem 154 can be secured against the first chamber base platform 164, which seals the first compartment 151 from the second compartment 152.

Figure 38A:
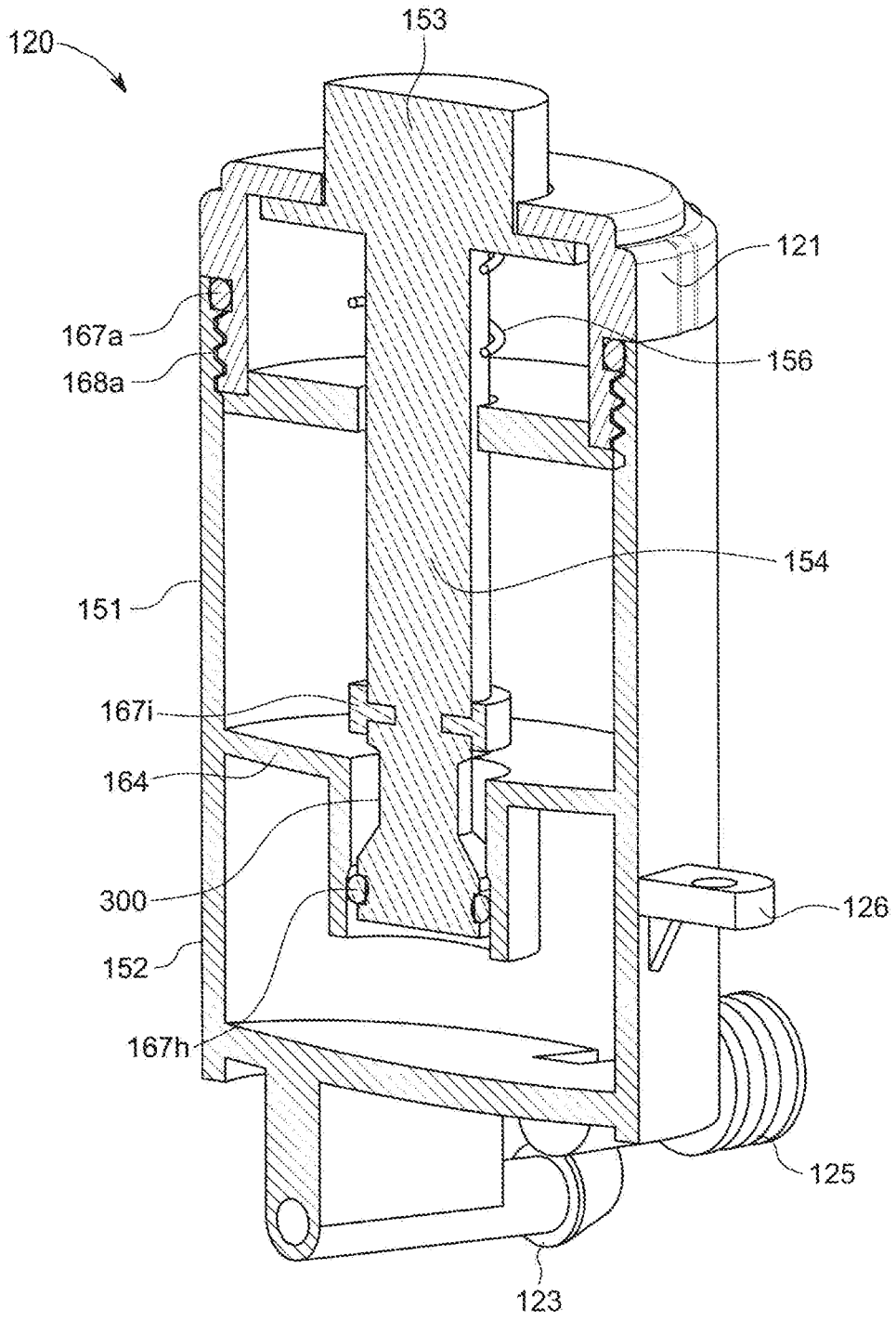
FIG. 38A illustrates an embodiment of a side cut-away view of a reservoir dispenser which uses a stem with a narrowed band.
Figure 38B:
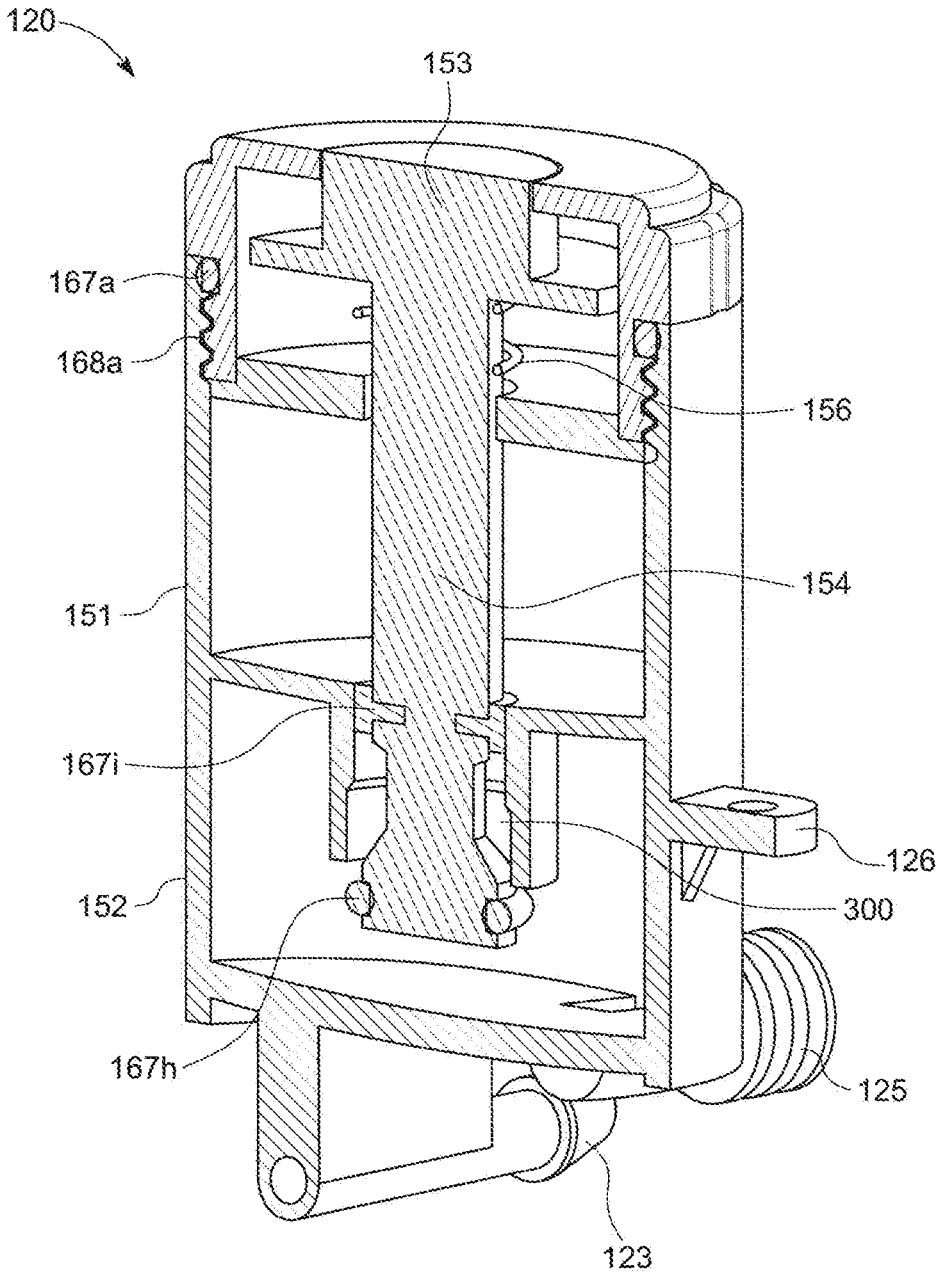
FIG. 38B illustrates illustrate an embodiment of a side cut-away view of a reservoir dispenser which uses a stem with a narrowed band.

FIGS. 38A and 38B illustrate an embodiment of a side cut-away view of a reservoir dispenser 120, which uses an activator 153 with a stem 154 having a narrowed band 300 in a distal region of the stem, and a lower O-ring 167*h* an upper O-ring 167*i* between the band for carrying liquid wash solution present in the first chamber to the water in the second chamber. In embodiments, the activator 153 can be manually pushed downwards to activate introduction of the liquid wash solution.

As shown in FIG. 38A, initially the liquid wash solution present in the first chamber 151 remains separated from the water in the second chamber 152 by action of the O-ring 167*h* beneath the narrowed band 300 on the stem 154 pressing against the first chamber base platform 164. As described above, an aliquot of the liquid wash solution in the first chamber 151 can enter the band in the stem 154 but cannot enter the second chamber 152.

As shown in FIG. 38B, downward force on the activator 153 causes the spring 156 to compress, which allows the stem 154, lower O-ring 167*h* and an aliquot of the liquid wash solution present in the narrowed band 300 to enter the second chamber 152, where upon the liquid wash solution is mixed with the water present in this chamber. The first chamber 151 and the second chamber 152 remain separated by the upper O-ring 167*i* sealing against the stem 154.

When the input pressure is no longer high enough due to upwards motion or release of the activator 153, then the spring 156 pushes the stem 154 upwards and the lower O-ring 167*h* presses against the first chamber base platform 164 thereby separating the first chamber 151 from the second chamber 152.

While the inventive natures have been particularly shown and described with reference to preferred embodiments thereof, it will be understood by those in the art that the foregoing and other changes can be made therein without departing from the spirit and the scope of the disclosure. Likewise, the various diagrams may depict an example architectural or other configuration for the disclosure, which is done to aid in understanding the features and functionality that can be included in the disclosure. The disclosure is not restricted to the illustrated example architectures or configurations but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a pan of a described embodiment. Thus, the breadth and scope of the disclosure should not be limited by any of the above-described exemplary embodiments.

What is claimed is:

1. A reservoir dispenser for a bidet apparatus, comprising:

a housing unit having a first chamber and a second chamber, wherein the first chamber is capable of holding liquid wash solution separate from the second chamber;

a water inlet and a water outlet on the second chamber;

a lid having an opening therein, wherein the lid is attached to the first chamber;

an activator having a stem and a stem endpiece, wherein the activator is within the opening of the lid, and the stem and stem endpiece are in the first chamber; and a check valve between the first chamber and the second chamber, wherein engaging the activator allows for transfer of the liquid wash solution from the first chamber, through the check valve and into the second chamber.

2. The reservoir dispenser of claim 1, wherein the activator is a push-button, a twist-button, a pull up and push down button, a slide button, a plunger button, a lever, or a knob.

3. The reservoir dispenser of claim 1, wherein the check valve between the first chamber and the second chamber is a spring-loaded check valve, diaphragm check valve, umbrella check valve, or a duckbill check valve.

4. The reservoir dispenser of claim 1, further including:

a spring surrounding the stem;

a barrel surrounding the spring and the stem, wherein the barrel includes a top region, a middle region, and a lower region, wherein the top region is in the first chamber, the middle region is between the first chamber and the second chamber, and the lower region is in the second chamber.

5. The reservoir dispenser of claim 4, wherein the check valve includes:

a check valve body including sidewalls of the middle region and/or lower region of the barrel;

a check valve disc;

a check valve spring; and a check valve guide having one or more openings there through.

6. The reservoir dispenser of claim 5, wherein the middle region of the barrel includes one or more openings to allow the liquid wash solution present in the first chamber to pass through to the check valve disc.

7. The reservoir dispenser of claim 6, wherein engaging the activator allows the stem end piece to press against the liquid wash solution that passed through to the check valve disc and against the check valve body, thereby forcing the check valve disc downwards and compressing the check valve spring, allowing the liquid wash solution to pass through the one or more openings in the check valve guide and into the second chamber.

8. The reservoir dispenser of claim 7, wherein disengaging the activator elongates the check valve spring and forces the check valve disc upwards, which separates the first chamber from the second chamber.

9. A reservoir dispenser for a bidet apparatus, comprising:

a housing unit having a first chamber and a second chamber, wherein the first chamber is capable of holding liquid wash solution separate from the second chamber;

a water inlet and a water outlet on the second chamber;

a lid having an opening therein, wherein the lid is attached to the first chamber;

an annular ring between the first chamber and the second chamber;

an activator having a stem with a top ring, a medial ring, and a distal ring, wherein the top ring and medial ring are in the first chamber and the distal ring is in the second chamber, wherein engaging the activator allows for transfer of the liquid wash solution from the first chamber, through the annular ring and into the second chamber.

10. The reservoir dispenser of claim 9, wherein the activator is a push-button, a twist-button, a pull up and push down button, a slide button, a plunger button, a lever, or a knob.

11. The reservoir dispenser of claim 9, wherein the annular ring includes an internal lip, wherein the internal lip is between the first chamber and the second chamber.

12. The reservoir dispenser of claim 11, further including a post and one or more springs surrounding the post on a floor of the second chamber, wherein the stem includes an inlet for accepting the post.

13. The reservoir dispenser of claim 12, wherein the liquid wash solution present in the first chamber fills an area between the medial ring and the distal ring of the activator.

14. The reservoir dispenser of claim 13, wherein engaging the activator allows the medial ring of the stem to press against the liquid wash solution, thereby forcing the distal ring of the stem downwards and compressing the one or more springs on the floor of the second chamber, allowing the liquid wash solution to pass the internal lip of the annular ring and into the second chamber.

15. The reservoir dispenser of claim 14, wherein disengaging the activator elongates the one or more springs on the floor of the second chamber and forces the stem upwards, which separates the first chamber from the second chamber.

16. A reservoir dispenser for a bidet apparatus, comprising:

a housing unit having a first chamber and a second chamber, wherein the first chamber is capable of holding liquid wash solution separate from the second chamber;

a water inlet and a water outlet on the second chamber;

a lid having an opening therein, wherein the lid is attached to the first chamber;

an activator having a stem with one or more grooved openings in a distal region of the stem, wherein the activator is within the opening of the lid and the stem and the one or more grooved openings are in the first chamber, wherein engaging the activator allows for transfer of the liquid wash solution from the first chamber into the second chamber.

17. The reservoir dispenser of claim 16, wherein the activator is a push-button, a twist-button, a pull up and push down button, a slide button, a plunger button, a lever, or a knob.

18. The reservoir dispenser of claim 16, further including:

a spring surrounding the stem;

a barrel surrounding the spring and the stem in the first chamber, wherein the barrel includes a top region and a bottom region.

19. The reservoir dispenser of claim 18, wherein the stem includes an O-ring encircling an area of the stem between the one or more grooved openings and a terminal end of the stem.

20. The reservoir dispenser of claim 19, wherein the bottom region of the barrel includes one or more openings to allow the liquid wash solution present in the first chamber to pass through to fill the one or more grooved openings in the distal region of the stem.

21. The reservoir dispenser of claim 20, wherein engaging the activator allows the stem and liquid wash solution present in the one or more grooved openings in the distal region of the stem downwards and compressing the spring surrounding the stem, allowing the liquid wash solution present in the one or more grooved openings to pass through the first chamber and into the second chamber.

22. The reservoir dispenser of claim 21, wherein disengaging the activator elongates the spring surrounding the stem and forces the stem upwards, which separates the first chamber from the second chamber.

23. A reservoir dispenser for a bidet apparatus, comprising:

a housing unit having a first chamber and a second chamber, wherein the first chamber is capable of holding liquid wash solution separate from the second chamber;

a water inlet and a water outlet on the second chamber;

a lid having an opening therein, wherein the lid is attached to the first chamber;

an activator having a stem with a narrowed band in a distal region, wherein the activator is within the opening of the lid and the stem and the narrowed band are in the first chamber, wherein engaging the activator allows for transfer of the liquid wash solution from the first chamber into the second chamber.

24. The reservoir dispenser of claim 21, wherein the activator is a push-button, a twist-button, a pull up and push down button, a slide button, a plunger button, a lever, or a knob.

25. The reservoir dispenser of claim 23, further including a spring surrounding the stem.

26. The reservoir dispenser of claim 25, wherein the stem includes an upper O-ring encircling an area of the stem above the narrowed band; and a lower O-ring encircling an area of the stem below the narrowed band and a terminal end of the stem.

27. The reservoir dispenser of claim 26, wherein engaging the activator allows the stem and liquid wash solution present in the narrowed band in the distal region of the stem downwards and compressing the spring surrounding the stem, allowing the liquid wash solution present in the narrowed band of the stem to pass through the first chamber and into the second chamber.

28. The reservoir dispenser of claim 27, wherein disengaging the activator elongates the spring surrounding the stem and forces the stem upwards, which separates the first chamber from the second chamber.

* * * * *